US008944886B2

(12) United States Patent
Schwappach et al.

(10) Patent No.: US 8,944,886 B2
(45) Date of Patent: Feb. 3, 2015

(54) ABRASIVE SLURRY AND DRESSING BAR FOR EMBEDDING ABRASIVE PARTICLES INTO SUBSTRATES

(75) Inventors: Karl G. Schwappach, North Oaks, MN (US); Zine-Eddine Boutaghou, North Oaks, MN (US)

(73) Assignee: RDC Holdings, LLC, North Oaks, MN (US)

( * ) Notice: Subject to any disclaimer, the term of this patent is extended or adjusted under 35 U.S.C. 154(b) by 531 days.

(21) Appl. No.: 13/289,797

(22) Filed: Nov. 4, 2011
(Under 37 CFR 1.47)

(65) Prior Publication Data

US 2012/0149283 A1 Jun. 14, 2012

Related U.S. Application Data

(63) Continuation of application No. 12/784,908, filed on May 21, 2010, now Pat. No. 8,801,497, which is a continuation-in-part of application No. 12/766,473, filed on Apr. 23, 2010, now abandoned.

(Continued)

(51) Int. Cl.
*B24B 1/00* (2006.01)
*B24D 11/00* (2006.01)

(52) U.S. Cl.
CPC ..... *B24D 11/00* (2013.01)
USPC ..... 451/28; 451/56

(58) Field of Classification Search
USPC ..... 451/28, 540, 550, 41, 56, 443; 51/298, 51/307, 295; 428/141
See application file for complete search history.

(56) References Cited

U.S. PATENT DOCUMENTS

| | | | |
|---|---|---|---|
| 3,683,562 | A | 8/1972 | Day |
| 3,921,342 | A | 11/1975 | Day |
| 4,821,461 | A | 4/1989 | Holmstrand |
| 4,980,536 | A | 12/1990 | Asch et al. |
| 5,024,968 | A | 6/1991 | Engelsberg |
| 5,099,557 | A | 3/1992 | Engelsberg |
| 5,152,917 | A | 10/1992 | Pieper et al. |
| 5,212,873 | A | 5/1993 | McMurtry |
| 5,304,223 | A | 4/1994 | Pieper et al. |
| 5,386,666 | A | 2/1995 | Cole |
| 5,435,816 | A | 7/1995 | Spurgeon |
| 5,437,754 | A | 8/1995 | Calhoun |

(Continued)

FOREIGN PATENT DOCUMENTS

| | | | |
|---|---|---|---|
| CN | 1222431 | A | 7/1999 |
| DE | 102004058797 | A1 | 1/2006 |

(Continued)

OTHER PUBLICATIONS

Application and File history for U.S. Appl. No. 12/424,441, filed Apr. 15, 2009. Inventors: Boutaghou et al.

(Continued)

*Primary Examiner* — Dung Van Nguyen

(57) ABSTRACT

An abrasive polishing slurry including abrasive particles in a carrier fluid and micro-nano members. A system and method for making an abrasive article using the polishing slurry is also disclosed. The system includes a gimballed dressing bar adapted to provide a compressive force sufficient to embed the abrasive particles into the substrate, wherein the members set a height the embedded abrasive particles protrude above the substrate.

16 Claims, 48 Drawing Sheets

Related U.S. Application Data

(60) Provisional application No. 61/174,472, filed on Apr. 30, 2009, provisional application No. 61/187,658, filed on Jun. 16, 2009, provisional application No. 61/220,149, filed on Jun. 24, 2009, provisional application No. 61/221,554, filed on Jun. 30, 2009, provisional application No. 61/232,425, filed on Aug. 8, 2009, provisional application No. 61/232,525, filed on Aug. 10, 2009, provisional application No. 61/248,194, filed on Oct. 2, 2009, provisional application No. 61/267,031, filed on Dec. 5, 2009, provisional application No. 61/267,030, filed on Dec. 5, 2009.

(56) References Cited

U.S. PATENT DOCUMENTS 5,454,844 A 10/1995 Hibbard et al.
5,456,736 A 10/1995 Waki et al.
5,489,235 A 2/1996 Gagliardi et al.
5,494,473 A 2/1996 Dupuis et al.
5,591,073 A 1/1997 Turgeon
5,632,669 A 5/1997 Azarian et al.
5,643,343 A 7/1997 Selifanov et al.
5,725,617 A 3/1998 Hagiwara et al.
5,774,305 A 6/1998 Boutaghou
5,827,112 A 10/1998 Ball
5,849,135 A 12/1998 Selwyn
5,856,896 A 1/1999 Berg et al.
5,858,474 A 1/1999 Meyer et al.
5,877,088 A 3/1999 Samitsu et al.
5,885,131 A 3/1999 Azarian et al.
5,958,794 A 9/1999 Bruxvoort et al.
5,991,113 A 11/1999 Meyer et al.
6,069,771 A 5/2000 Boutaghou et al.
6,092,253 A 7/2000 Moinpour et al.
6,118,426 A 9/2000 Albert et al.
6,120,588 A 9/2000 Jacobson
6,121,143 A 9/2000 Messner et al.
6,123,612 A 9/2000 Goers
6,135,856 A 10/2000 Tjaden et al.
6,153,281 A 11/2000 Meyer et al.
6,157,515 A 12/2000 Boutaghou
6,177,921 B1 1/2001 Comiskey et al.
6,194,317 B1 2/2001 Kaisaki et al.
6,209,411 B1 4/2001 McMurtry
6,252,564 B1 6/2001 Albert et al.
6,270,392 B1 8/2001 Hayashi et al.
6,273,793 B1 8/2001 Liners et al.
6,312,971 B1 11/2001 Amundson et al.
6,334,229 B1 1/2002 Moinpour et al.
6,358,123 B1 3/2002 Liners et al.
6,406,504 B1 6/2002 Lise et al.
6,413,790 B1 7/2002 Duthaler et al.
6,422,687 B1 7/2002 Jacobson
6,459,260 B1 10/2002 Bonin et al.
6,459,418 B1 10/2002 Comiskey et al.
6,493,192 B2 12/2002 Crane et al.
6,521,489 B2 2/2003 Duthaler et al.
6,543,299 B2 4/2003 Taylor
6,545,291 B1 4/2003 Amundson et al.
6,568,992 B1 5/2003 Angelo et al.
6,612,917 B2 9/2003 Bruxvoort
6,634,929 B1 10/2003 Visser
6,639,578 B1 10/2003 Comiskey et al.
6,652,075 B2 11/2003 Jacobson
6,652,354 B2 11/2003 Hayashi et al.
6,669,745 B2 12/2003 Prichard et al.
6,714,386 B1 3/2004 Polycarpou et al.
6,744,602 B2 6/2004 Rao et al.
6,750,473 B2 6/2004 Amundson et al.
6,761,746 B2 7/2004 Rich et al.
6,769,975 B2 8/2004 Sagawa
6,805,137 B2 10/2004 Bailey et al.
6,811,467 B1 11/2004 Beresford et al.
6,821,189 B1 11/2004 Coad et al.
6,825,829 B1 11/2004 Albert et al.
6,857,937 B2 2/2005 Bajorek
6,872,127 B2 3/2005 Lin et al.
6,875,086 B2 4/2005 Golzarian et al.
6,900,135 B2 5/2005 Somekh et al.
6,929,539 B2 8/2005 Schutz et al.
6,935,013 B1 8/2005 Markevitch et al.
6,949,128 B2 9/2005 Annen
6,952,330 B1 10/2005 Riddering et al.
6,953,385 B2 10/2005 Singh, Jr.
6,963,464 B2 11/2005 Xu et al.
6,967,640 B2 11/2005 Albert et al.
6,984,935 B2 1/2006 Chiu et al.
7,057,856 B2 6/2006 Bonin et al.
7,148,128 B2 12/2006 Jacobson
7,160,178 B2 1/2007 Gagliardi et al.
7,185,384 B2 3/2007 Sun et al.
7,189,333 B2 3/2007 Henderson
7,193,805 B1 3/2007 Haddock
7,195,549 B2 3/2007 Baldoni et al.
7,198,553 B2 4/2007 Goers
7,203,033 B2 4/2007 Boutaghou
7,218,478 B2 5/2007 Mate et al.
7,262,931 B2 8/2007 Nakamura et al.
7,275,311 B2 10/2007 Markevitch et al.
7,326,102 B2 2/2008 Fujii et al.
7,355,810 B2 4/2008 Asakura
7,367,875 B2 5/2008 Slutz et al.
7,382,363 B2 6/2008 Albert et al.
7,383,723 B2 6/2008 Tregub et al.
7,388,726 B1 6/2008 McKenzie et al.
7,404,756 B2 7/2008 Ouderkirk et al.
7,428,124 B1 9/2008 Song et al.
7,430,098 B1 9/2008 Song et al.
7,455,810 B2 11/2008 Fontana et al.
7,456,538 B2 11/2008 Nai et al.
7,465,217 B2 * 12/2008 Kinoshita et al. ..... 451/28
7,469,443 B2 12/2008 Liou et al.
7,485,345 B2 2/2009 Renn et al.
7,651,386 B2 * 1/2010 Sung ..... 451/56
8,414,362 B2 * 4/2013 Sung ..... 451/443
2003/0126804 A1 7/2003 Rosenflanz et al.
2003/0148106 A1 8/2003 Ma et al.
2004/0033772 A1 2/2004 Goers
2004/0040575 A1 3/2004 Tregub et al.
2004/0072510 A1 4/2004 Kinoshita et al.
2004/0224508 A1 11/2004 Engel et al.
2005/0032462 A1 2/2005 Gagliardi et al.
2005/0071986 A1 4/2005 Lackey et al.
2005/0287032 A1 12/2005 Tregub et al.
2006/0025059 A1 2/2006 Gueorguiev et al.
2006/0285248 A1 12/2006 Pust et al.
2007/0035881 A1 2/2007 Burbank et al.
2007/0093181 A1 4/2007 Lugg et al.
2007/0107317 A1 5/2007 Takahagi et al.
2007/0111645 A1 5/2007 Hu et al.
2008/0004743 A1 1/2008 Goers et al.
2008/0008822 A1 1/2008 Kowalski et al.
2008/0015102 A1 1/2008 Rosenflanz et al.
2008/0053000 A1 3/2008 Palmgren et al.
2008/0199360 A1 8/2008 Shahriari
2009/0038234 A1 2/2009 Yin
2009/0067082 A1 3/2009 Albrecht
2010/0000160 A1 1/2010 Lugg et al.
2010/0266812 A1 10/2010 Lugg
2010/0266862 A1 10/2010 Lugg et al.
2010/0279586 A1 11/2010 Schwappach et al.
2010/0317262 A1 * 12/2010 Boutaghou ..... 451/41
2010/0330890 A1 12/2010 Boutaghou
2011/0027549 A1 * 2/2011 Boutaghou ..... 428/206
2011/0034107 A1 2/2011 Boutaghou
2011/0104989 A1 * 5/2011 Boutaghou et al. ..... 451/28
2011/0143638 A1 * 6/2011 Boutaghou ..... 451/28
2011/0159784 A1 6/2011 Boutaghou et al.
2011/0230126 A1 9/2011 Boutaghou
2011/0244770 A1 10/2011 Boutaghou
2011/0256803 A1 10/2011 Boutaghou
2012/0122380 A1 5/2012 Schwappach et al.
2012/0149279 A1 6/2012 Schwappach et al.

(56) References Cited

U.S. PATENT DOCUMENTS

| | | | |
|---|---|---|---|
| 2012/0281315 | A1 | 11/2012 | Schwappach et al. |
| 2013/0005229 | A1 | 1/2013 | Schwappach et al. |
| 2013/0040542 | A1 | 2/2013 | Schwappach et al. |

FOREIGN PATENT DOCUMENTS

| | | | |
|---|---|---|---|
| JP | 10286777 | | 10/1998 |
| WO | WO 95/07797 | A1 | 3/1995 |
| WO | WO 95/22436 | A1 | 8/1995 |
| WO | WO 02/29813 | A2 | 4/2002 |

OTHER PUBLICATIONS

Application and File history for U.S. Appl. No. 12/753,479, filed Apr. 2, 2010. Inventors: Boutaghou.

Application and File history for U.S. Appl. No. 12/766,473, filed Apr. 23, 2010. Inventors: Walker et al.

Application and File history for U.S. Appl. No. 12/766,515, filed Apr. 23, 2010. Inventors: Boutaghou et al.

Application and File history for U.S. Appl. No. 12/784,908, filed May 21, 2010. Inventors: Boutaghou et al.

Application and File history for U.S. Appl. No. 13/275,948, filed Oct. 18, 2011. Inventors: Schwappach et al.

Application and File history for U.S. Appl. No. 13/284,631, filed Oct. 28, 2011. Inventors: Schwappach et al.

Application and File history for U.S. Appl. No. 13/423,396, filed Mar. 19, 2012. Inventor: Schwappach et al.

Application and File history for U.S. Appl. No. 13/430,297, filed Mar. 26, 2012. Inventors: Schwappach et al.

Application and File history for U.S. Appl. No. 13/492,513, filed Jun. 8, 2012. Inventors: Schwappach et al.

Application No. PCT/US2010/040595, filed Jun. 30, 2010, International Search Report and Written Opinion dated Oct. 5, 2010.

* cited by examiner

ABRASIVE SLURRY AND DRESSING BAR FOR EMBEDDING ABRASIVE PARTICLES INTO SUBSTRATES

RELATED APPLICATIONS

The present application is a continuation of U.S. application Ser. No. 12/784,908, entitled Array of Abrasive Members with Resilient Support, filed May 21, 2010, which is a continuation-in-part of U.S. application Ser. No. 12/766,473, entitled Abrasive Article with Array of Gimballed Abrasive Members and Method of Use, filed Apr. 23, 2010, which claims the benefit of U.S. Provisional Patent Application Nos. 61/174,472 entitled Method and Apparatus for Atomic Level Lapping, filed Apr. 30, 2009; 61/187,658 entitled Abrasive Member with Uniform Height Abrasive Particles, filed Jun. 16, 2009; 61/220,149 entitled Constant Clearance Plate for Embedding Diamonds into Lapping Plates, filed Jun. 24, 2009; 61/221,554 entitled Abrasive Article with Array of Gimballed Abrasive Members and Method of Use, filed Jun. 30, 2009; 61/232,425 entitled Constant Clearance Plate for Embedding Abrasive Particles into Substrates, filed Aug. 8, 2009; 61/232,525 entitled Method and Apparatus for Ultrasonic Polishing, filed Aug. 10, 2009; 61/248,194 entitled Method and Apparatus for Nano-Scale Cleaning, filed Oct. 2, 2009; 61/267,031 entitled Abrasive Article with Array of Gimballed Abrasive Members and Method of Use, entitled Dec. 5, 2009; and 61/267,030 entitled Dressing Bar for Embedding Abrasive Particles into Substrates, filed Dec. 5, 2009, all of which are hereby incorporated by reference.

FIELD OF THE INVENTION

The present disclosure is directed to an abrasive polishing slurry including abrasive particles in a carrier fluid and micro-nano members. A system and method for making an abrasive article using the polishing slurry is also disclosed. The system includes a gimballed dressing bar adapted to provide a compressive force sufficient to embed the abrasive particles into the substrate, wherein the members set a height the embedded abrasive particles protrude above the substrate.

BACKGROUND OF THE INVENTION

Read-write heads for disk drives are formed at the wafer level using a variety of deposition and photolithographic techniques. Multiple sliders, up to as many as 40,000, may be formed on one wafer. The wafer is then sliced into slider bars, each having up to 60-70 sliders. The slider bars are lapped to polish the surface that will eventually become the air bearing surface. A carbon overcoat is then applied to the slider bars. Finally, individual sliders are sliced from the bar and mounted on gimbal assemblies for use in disk drives.

Slider bars are currently lapped using a tin plate charged with small diamonds having an average diameter of about 250 nm. FIG. 1A illustrates a conventional tin substrate 20 charged with diamonds 22. Top surface 24 of the tin plate typically has a certain amount of waviness. The height 26 of the diamonds 22 tends to follow the contour of the top surface 24, even after the substrate 20 is dressed. The waviness of the top surface 24 also creates a non-uniform hydrostatic film 28 during lapping operations, creating instability at the interface with the slider bars.

Conventional tin substrate is prepared in several steps. The first step is to machine a flat tin plate. The second step is to machine grooves or geometrical features that promote lubricant circulation and control the thickness of the hydrodynamic film between the oil lubricant and the slider bars.

The third step is to charge the tin plate with diamonds, such as illustrated in U.S. Pat. No. 6,953,385 (Singh, Jr.). Singh teaches applying a ceramic impregnator downward on the substrate surface with a controlled force while the diamond slurry is supplied. The diamonds are impregnated into the relatively soft tin layer of the substrate.

Fourth, the impregnated substrate is dressed with a dressing bar. The dressing bar reduces the height variation by pressing the larger diamonds further into the tin, producing a more uniform height of the diamonds. Several runs of the dressing bar help improve height uniformity of the abrasive diamonds impregnated into the tin.

FIG. 1B illustrates a conventional dressing bar 30. The leading edge 32 of the dressing bar 30 is designed with a sharp ninety-degree angle interfacing with the diamonds during the abrasive particles embedding process. The sharp leading edge 32 does not allow for efficient penetration of diamonds into the interface defined by the dressing bar and the substrate. This process generates a large amount of industrial waste. Current processes are wasteful since over 90 percent of the diamonds are lost and unrecoverable in the process.

During use, the substrate is flooded with a lubricant (oil or water based). The viscosity of oil-based lubricants is about 4 orders of magnitude greater than the viscosity of air. The lubricant causes a hydrodynamic film to be generated between the slider bar and the substrate. The hydrodynamic film is critical in establishing a stable interface during the lapping process and to reduce vibrations and chatter. To overcome the hydrodynamic film, a relatively large force is exerted onto the slider bar to cause interference with the diamonds necessary to promote polishing. A preload of about 10 kilograms is not uncommon to engage a single slider bar with the lapping media.

FIG. 2 is a schematic side sectional view of a conventional slider bar including a plurality of individual sliders before lapping. Each slider in the slider bar typically includes read-write transducers. As used herein, "read-write transducer" refers to one or more of the return pole, the write pole, the read sensor, magnetic shields, and any other components that are spacing sensitive. Various methods and systems for finish lapping read-write transducers are disclosed in U.S. Pat. No. 5,386,666 (Cole); U.S. Pat. No. 5,632,669 (Azarian et al.); U.S. Pat. No. 5,885,131 (Azarian et al.); U.S. Pat. No. 6,568,992 (Angelo et al.); and U.S. Pat. No. 6,857,937 Bajorek), which are hereby incorporated by reference.

Variables such as lapping media speed, preload on the slider bar load, nominal diamond size, and lubricant type must be balanced to yield a desirable material removal rate and finish. A balance is also required between the hydrodynamic film and the height of the embedded diamonds to achieve an interference level between the slider bar and the diamonds.

The preload applied to the slider bar is typically determined by the density of the diamonds and the diamond height variation. As the industry moves to nano-diamonds smaller than 250 nm, the preload will need to be increased to reduce the fluid film thickness a sufficient amount so the diamonds contact the slider bars. Nano-diamonds are difficult to embed in the tin plate. The risk of free diamonds damaging the slider bar increases.

Slider bars with trailing edges composed of metallic layers and ceramic layers present very severe challenges during lapping. Composite structures of hard and soft layers present differential lapping rates when lapped using conventional abrasive substrates. The variable polishing rates of the metallic and ceramic materials lead to severe recessions, sensor damage, and other problems. FIG. 3 illustrates the bar of FIG. 2 after lapping with a conventional diamond-charged substrate. The diamond-charged plates cause large transducer protrusion and recession variations, contact detection area variation, substrate recession, microscopic substrate fractures leading to particle release during operation of the disk drive, scratches from free diamonds, and transducer damage.

The realization of a data density of 1 Terabyte/inch (1 Tbit/in$^2$) or higher depends, in part, on designing a head-disk interface (HDI) with the smallest possible head-media spacing ("HMS"). Head-media spacing refers to the distance between a read or write sensor and a surface of a magnetic media. A discussion of head-media spacing is found in U.S. patent application Ser. No. 12/424,441, entitled Method and Apparatus for Reducing Head Media Spacing in a Disk Drive, filed Apr. 15, 2009, which is hereby incorporated by reference. Conventional diamond charged plates used to lap slider bars are an impediment to achieving data densities on the order of 1 Tbit/in$^2$.

U.S. Pat. Nos. 7,198,533 and 6,123,612 disclose an abrasive article including a plurality of abrasive particles securely affixed to a substrate with a corrosion resistant matrix material. The matrix material includes a sintered corrosion resistant powder and a brazing alloy. The brazing alloy includes an element which reacts with and forms a chemical bond with the abrasive particles, thereby securely holding the abrasive particles in place. A method of forming the abrasive article includes arranging the abrasive particles in the matrix material, and applying sufficient heat and pressure to the mixture of abrasive particles and matrix material to cause the corrosion resistant powder to sinter, the brazing alloy flows around, react with, and forms chemical bonds with the abrasive particles, and allows the brazing alloy to flow through the interstices of the sintered corrosion resistant powder and forms an inter-metallic compound therewith.

U.S. Pat. Publication No. 2009/0038234 (Yin) discloses a method for making a conditioning pad using a plastic substrate having a plurality of recesses. The abrasive grains are secured in the recesses by adhesive. The second substrate is formed around the exposed portions of the abrasive grains. After the second substrate hardens, the first substrate is removed, exposing the cutting surfaces of the abrasive grains.

Example 1 of Yin teaches recesses are about 225 micrometers deep and about 450 micrometers wide, with a maximum height difference between the highest and lowest peak of about 25 micrometers. Example 3 of Yin discloses a maximum height difference between the highest and lowest peak of about 15 micrometers. Yin discloses diamond abrasive grains with particle diameters ranging from 10 mesh to 140 mesh. Applicants believe these mesh sizes correspond generally to abrasive particles with a major diameter of about 2 millimeters to about 0.1 millimeters. The large size of the diamonds of Yin allows for insertion into the recesses. Forming the first substrate with sub-micron sized recesses and then inserting sub-micron sized abrasive grains, however, is not currently commercially viable. Sorting sub-micron sized abrasive grains is also problematic.

Other methods for orienting and positioning discrete abrasive particles are disclosed in U.S. Pat. No. 6,669,745 (Prichard et al.) and U.S. Pat. No. 6,769,975 (Sagawa), and U.S. Pat. Publication No. 2008/0053000 (Palmgren), which are hereby incorporated by reference.

BRIEF SUMMARY OF THE INVENTION

The present invention is directed to one or more individually gimballed dressing bars for embedding abrasive particles into a substrate at a substantially uniform height. The present invention is also directed to an abrasive article with abrasive particles embedded in a substrate at a substantially uniform height, including a method of making and use the abrasive article. The abrasive article is typically nano-scale diamonds embedded in a Tin lapping plate. The present method and abrasive article can be used with the current infrastructure for lapping and polishing.

A hydrodynamic and/or hydrostatic fluid bearing (air is the typical fluid) is maintained between the dressing bar and the substrate. The fluid bearing permits the dressing bar to follow micrometer-scale and/or millimeter-scale wavelengths of waviness on the substrate, while maintaining a constant clearance, to uniformly embed the abrasive particle into the substrate. The abrasive particles are preferably partially embedded in the substrate before application of the dressing bar. The fluid can be gas, liquid, or a combination thereof. As used herein, "topography following" refers to a gimbaled dressing bar that generally follows millimeter-scale and/or micrometer-scale wavelengths of waviness at a generally uniform clearance above a substrate to reduce nanometer-scale height variations of abrasive particles on the surface.

The gimbal mechanism permits the dressing bar to move vertically, and in pitch and roll relative to the substrate. The fluid bearing provides vertical stiffness, and pitch and roll stiffness to the dressing bar, while controlling the spacing and pressure distribution across the fluid bearing features on the dressing bar. The high stiffness of the dressing bar reduces clearance loss and chatter emanating from particle interaction during embedding of the abrasive particles. Adjustments to certain variables, such as for example, the spacing, pitch and roll stiffness, and/or preload can be used to modify the force applied to the abrasive particles.

The primary forces involved in a given fluid bearing are the gimbal structure and the preload. The gimbal structure applies both pitch and roll moments to the dressing bar. If the gimbal is extremely stiff, the fluid bearing may not be able to form a pitch or roll angle. The preload and preload offset (location where the preload is applied) bias the dressing bar toward the substrate. The preload is typically applied by a different structure than the gimbal structure.

In hydrodynamic applications, fluid bearing surface geometries play a role in pressurization of fluid bearing surfaces, particularly on hydrodynamic fluid bearings. Possible geometries include tapers, steps, trenches, crowns, cross curves, twists, wall profile, and cavities. Finally, external factors such as viscosity of the bearing fluid and linear velocity play an extremely important role in pressurizing bearing structures.

In one embodiment, the spacing profile is achieved with a fluid bearing configured to achieve a pitch and roll stiffness capable of countering the forces emanating between the abrasive particles and the dressing bar during the charging process. In another embodiment, the spacing profile is achieved with the aid of actuators causing the dressing bar to maintain a desired spacing profile with respect to the substrate. The present systems and methods can be used with or without lubricants.

In one embodiment, the dressing bar includes a leading edge taper causing progressive interference with the embedded abrasive particles. In a second embodiment, the interference with the abrasive particles is controlled by pitch of the dressing bar. The pitch of the dressing bar can be achieved with a hydrostatic clearance profile or by appropriately controlling actuators acting on the dressing bar. Pads are optionally added to a tapered dressing bar to allow for a low frictional interface and a clearance setting between the dressing bar and the substrate.

Large forces are expected to incur during the process of embedding abrasives. The fluid bearing stiffness is designed to counter the cutting forces and moments emanating from the embedding process. The gimbal assembly allows the dressing bar to react to these cutting forces. The spacing control between the dressing bar and the substrate is crucial to controlling the height of the final embedded abrasives. The spacing control can be achieved by hydrostatic and/or hydrodynamic fluid bearings, with or without actuators.

The method of making an abrasive article in accordance with the present invention includes the steps of distributing a slurry including abrasive particles on a surface of a substrate. At least one dressing bar is connected to the support structure with a gimbal assembly. The gimbal assembly permits displacement of the dressing bar in at least pitch and roll. The dressing bar is biased toward the substrate to engage an active surface on the dressing bar with the slurry. A fluid bearing is generated between the dressing bar assembly and the substrate. The fluid bearing can be adjusted to control spacing between the dressing bar assembly and the substrate. The active surface of the dressing bar applies a compressive force sufficient to embed the abrasive particles into the surface.

The present method and apparatus permits the height of the abrasive particles relative to the substrate to be precisely controlled. Consequently, abrasive articles made using the present method and apparatus can be tailored for particular applications and process parameters, such as for example the customers preferred lubricant. In one embodiment, a first abrasive article is prepared for use with a first lubricant having a first viscosity and a second abrasive article is prepared for use with a second lubricant having a second viscosity different from the first viscosity.

The present application is directed to an abrasive article with abrasive particles that protruded a substantially uniform height above a reference surface. The present method permits the height the abrasive particles extend above the substrate to be precisely controlled, thereby allowing the hydrodynamic film of the lubricant to also be controlled. The present method is also suited for use with nano-scale abrasive particles.

The present uniform height fixed abrasive article provides a substantially uniform height of the diamonds (dh) with respect to a reference surface. A substantially uniform lubricating hydrodynamic film (hf) forms with respect to the reference surface. The lapping interference (I=dh−hf) defined as the difference between the diamond height and the hydrodynamic film is positive to promote material removal. The cutting forces and hydrodynamic pressure do not excessively deform the substrate as to interfere with the lapping process.

One embodiment is directed to a method of making an abrasive article including the step of preparing a master plate with a surface having a shape. A spacer layer is deposited on the surface of the master plate. A slurry including abrasive particles is deposited on a surface of the spacer layer. The abrasive particles have a primary diameter greater than a thickness of the spacer layer. A substrate having a surface generally complementary to the surface of the master plate is pressed against the slurry with sufficient force to embed the abrasive particles into the substrate and to penetrate the spacer to the surface of the master plate. The master plate and the spacer layer are separated from the substrate to expose abrasive particle protruding a substantially uniform height above a reference surface. The substantially uniform height corresponding to the thickness of the spacer layer.

In one embodiment, the slurry of abrasive particles includes an adhesive. The adhesive is at least partially cured to form a reference surface between the abrasive particles with a shape generally complementary to the surface of the spacer layer.

The master plate and the substrate can be flat, concave, convex, curvilinear, spherical, or grooved. In one embodiment, features are machined into the surface of the master plate. In another embodiment grooves are machined in the surface of the master plate and complementary grooves are machined in the surface of the substrate. The grooves include peaks and valleys. The peaks in the surface of the substrate include a peak height greater than a peak height of peaks on the surface of the master plate. The abrasive particles are embedded primarily in the peaks of the substrate.

The spacer layer can be deposited by sputtering, spraying, coating, or printing. In one embodiment, a discrete spacer layer is positioned on the surface of the master plate. By varying the thickness of the spacer layer, it is possible to vary the height the abrasive particles protrude above the reference surface. In one embodiment the spacer layer is a low surface tension material. In another embodiment the thickness of the spacer layer is greater than the height the abrasive particles protrude above the reference surface in order to compensate for deformation during the impregnating step.

Any size or composition of abrasive particles can be used with the method of the present invention. In one embodiment, the abrasive particles are diamonds with a primary diameter of less than about 10 micrometers. In another embodiment, the diamonds have a primary diameter of less than about 1 micrometer.

A hard coat layer is optionally applied to the surface of the master plate before depositing the spacer layer. The cured adhesive occupies gaps between the surface of the substrate and the surface of the spacer layer.

The substrate is selected from one of metals, polymeric materials, ceramics, and composites thereof. The substrate can be a flexible or a rigid material.

The present invention is also directed to a method of lapping a surface of a work piece. An abrasive article according to the present invention is positioned opposite the surface of the work piece. A lubricant is applied to the abrasive article. The surface of the work piece is engaged with the abrasive particles and moved relative to the abrasive article to form a substantially uniform hydrostatic film of lubricant between the surface of the work piece and the reference surface on the abrasive article. The work piece can be machined metal parts, silicon wafers, slider bars for hard disk drives, and the like.

The present invention is also directed to an abrasive article including a plurality of nano-scale abrasive particles embedded in a substrate and protruding a substantially uniform height above a reference surface formed by a cured adhesive located between the abrasive particles.

DETAILED DESCRIPTION OF THE INVENTION

Figure 1A:
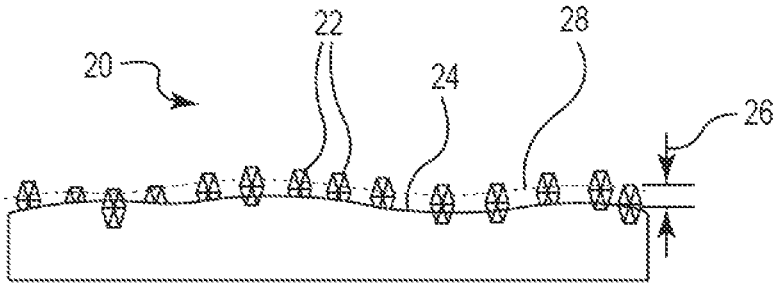
Fig. 1A (Prior Art)
FIG. 1A is a schematic sectional view of a prior art diamond-charged substrate.
Figure 1B:
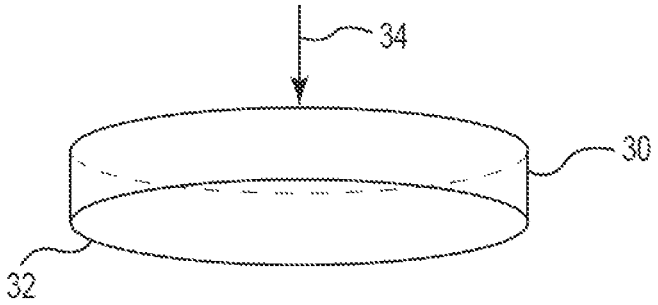
Fig. 1B (Prior Art)
FIG. 1B is a perspective view of a prior art dressing bar.
Figure 2:
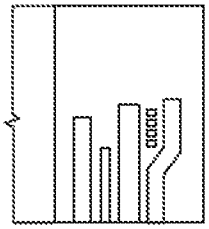
Fig. 2 (Prior Art)
FIG. 2 is a schematic side sectional view of a conventional slider bar before lapping.
Figure 3:
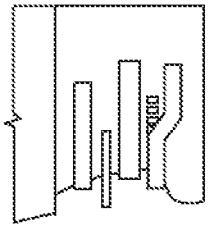
Fig. 3 (Prior Art)
FIG. 3 illustrates the bar of FIG. 2 after lapping with a conventional diamond-charged substrate.
Figure 4:
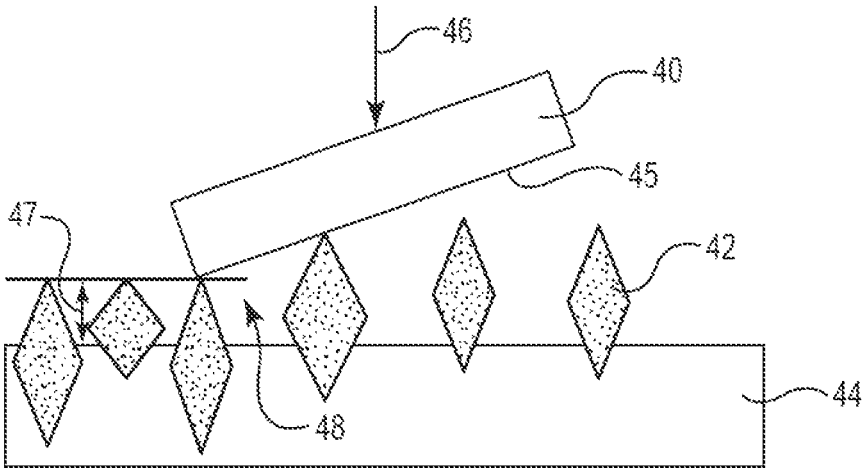
FIG. 4 is a schematic illustration of a method and apparatus for progressively embedding abrasive particles in accordance with an embodiment of the present invention.

FIG. 4 is a schematic illustration of dressing bar 40 using progressive interference to embed abrasive particles 42 into substrate 44. Progressive interference refers to a tapering gap interface 48 between active surface 45 of the dressing bar 40 and the substrate 44. In the illustrated embodiment, the dressing bar 40 is at an angle with respect to the substrate 44 to progressively embed the abrasive particles 42 into the substrate 44, resulting in a constant clearance 47 of the abrasive particles 42 relative to the substrate 44. The interference can be adjusted by changing the clearance 47, the slope of the active surface 45 relative to the substrate 44, adding a taper to the dressing bar (see FIG. 5A), or a combination thereof. Preload 46 may be in the range of about 1 kilogram, depending on a number of variables, such as for example, the size of the abrasive particles 42, the material of the substrate 44, and the like. As used herein, "clearance" refers to a distance between an active surface of a dressing bar and a substrate.

In one embodiment, the abrasive particles 42 are partially embedded in the substrate 44 before application of the dressing bar 40. As used herein, "embed" or "embedding" refers generically to pressing free and/or partially embedded abrasive particles into a substrate. The substrate is preferably plastically deformable to receive the abrasive particles.

Figure 5A:
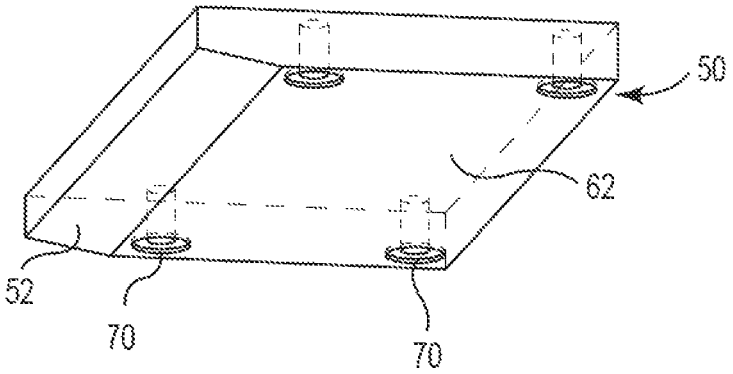
FIG. 5A is a perspective view of a tapered dressing bar in accordance with an embodiment of the present invention.
Figure 5B:
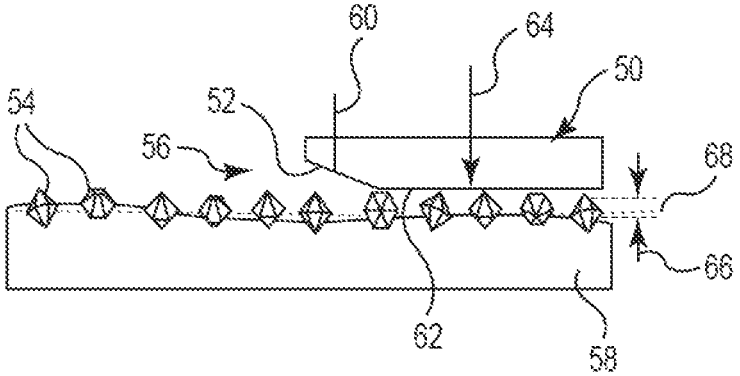
FIG. 5B is a side view of the tapered dressing bar of FIG. 5A engaged with an abrasive article in accordance with an embodiment of the present invention.

FIGS. 5A and 5B illustrate dressing bar 50 equipped with a tapered leading edge 52 in accordance with an embodiment of the present invention. The tapered leading edge 52 promotes progressive interference and facilitates entry of abrasive particles 54 into interface 56 between the dressing bar 50 and the substrate 58. The taper leading edge 52 applies a downward force 60 onto the abrasive particles 54 entrained by the relative motion imparted to the substrate 58. The abrasive particles 54 progressively penetrate the soft substrate 58. Methods of uniformly dispersing nanometer size abrasive grains are disclosed in U.S. Pat. Pub. No. 2007/0107317 (Takahagi et al.) which is hereby incorporated by reference.

A fluid bearing at the interface 56 controls the stiffness of the dressing bar 50 in the normal direction, pitch direction, and roll direction. Active surface 62 of the dressing bar 50 imparts a generally constant downward load 64 embedding the abrasive particles 54 further into the substrate 58. The spacing control between the dressing bar 50 and the substrate 58 assure a constant height 66 of the abrasive particles 54 above reference plane 68.

In the load dominated approach, once the load carried by the embedded diamonds 54 equals the applied load 64, the diamond embedding reaches equilibrium. The active surface 62 optionally includes hydrostatic ports 70, that will be discussed further below.

In a clearance dominated approach, the clearance between the diamond plate and the dressing bar is controlled via a hydrodynamic film or hydrostatic film. The stiffness of the hydrodynamic film is designed to be substantially higher than the countering stiffness emanating from the embedded diamond into the substrate. Upon interference of the dressing bar with respect to the abrasive particles, the later will offer little resistance to the force applied by the dressing bar.

The substrate 58 can be made from a variety of materials, such as for example, tin, a variety of other metals, polymeric materials, copper, ceramics, or composites thereof. The substrate 58 can also be flexible, rigid, or semi-rigid.

A hard coat is preferably applied to protect the surfaces 52, 62 of the dressing bar 50. The desired thickness of the hard coat can be in the range of about 100 nanometers or greater. In one embodiment, the hard coat is diamond-like carbon ("DLC") with a thickness of about 100 nanometers to about 200 nanometers. It is highly desirable to generate DLC hardness in the range of 70-90 giga-Pascals ("GPa"). In other embodiments, the hard coat is TiC, SiC, AlTiC.

In one embodiment the DLC is applied by chemical vapor deposition. As used herein, the term "chemically vapor deposited" or "CVD" refer to materials deposited by vacuum deposition processes, including, but not limited to, thermally activated deposition from reactive gaseous precursor materials, as well as plasma, microwave, DC, or RF plasma arc jet deposition from gaseous precursor materials. Various methods of applying a hard coat to a substrate are disclosed in U.S. Pat. Nos. 6,821,189 (Coad et al.); U.S. Pat. No. 6,872,127 (Lin et al.); U.S. Pat. No. 7,367,875 (Slutz et al.); and U.S. Pat. No. 7,189,333 (Henderson), which are hereby incorporated by reference.

Abrasive particles of any composition and size can be used with the method and apparatus of the present invention. The preferred abrasive particles 54 are diamonds with primary diameters less than about 1 micrometer, also referred to as nano-scale. For some applications, however, the diamonds can have a primary diameter of about 100 nanometers to about 20 micrometers. The abrasive particles may also be present in the form of an abrasive agglomerate. The abrasive particles in each agglomeration may be held together by an agglomerate binder. Alternatively, the abrasive particles may bond together by inter-particle attraction forces. Examples of suitable abrasive particles include fused aluminum oxide, heat treated aluminum oxide, white fused aluminum oxide, porous aluminas, transition aluminas, zirconia, tin oxide, ceria, fused alumina zirconia, or alumina-based sol gel derived abrasive particles.

Figure 6:
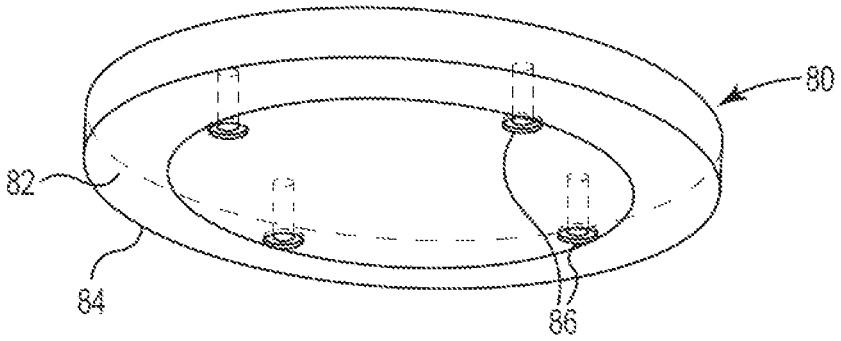
FIG. 6 is a perspective view of a circular tapered dressing bar in accordance with an embodiment of the present invention.

FIG. 6 illustrates a circular dressing bar 80 with a tapered edge 82 extending substantially around perimeter 84 in accordance with an embodiment of the present invention. The dressing bar 80 optionally includes hydrostatic ports 86, that are discussed below.

Figure 7:
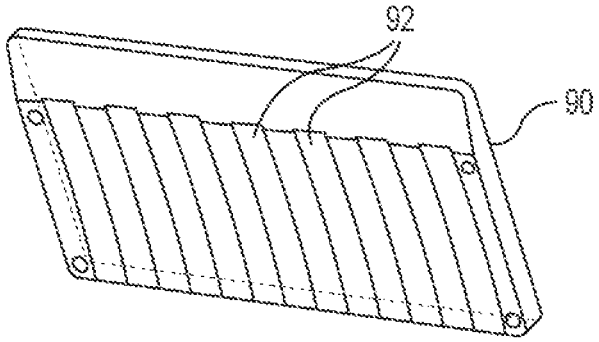
FIG. 7 is a perspective view of a grooved and tapered dressing bar in accordance with an embodiment of the present invention.

FIG. 7 illustrates an alternate dressing bar 90 with slots or grooves 92 in accordance with an embodiment of the present invention. During the embedding process, the abrasive particles are displaced into the grooves 92, simulating grooves on the resulting substrate, without the need for a machining step.

FIG. 7 illustrates an alternate dressing bar 90 with slots or grooves 92 in accordance with an embodiment of the present invention. The grooves 92 are fabricated to reduce the magnitude of the hydrodynamic fluid bearing. The grooves are recessed with respect to land 94 and do not participate in embedding the abrasive particle into the substrate. The grooves 92 also control the amount of abrasive particles being embedded at any giving time, reducing the required preload. The grooves 92 can also be used for form a patterns of abrasive particles in the substrate.

Figure 8:
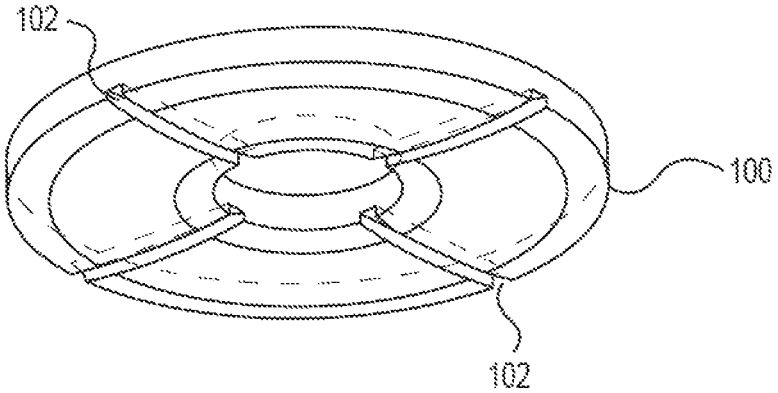
FIG. 8 is a perspective view of an alternate grooved and tapered dressing bar in accordance with an embodiment of the present invention.

FIG. 8 is a circular dressing bar 100 with slots 102 that permit the abrasive slurry to circulate during the embedding process in accordance with an embodiment of the present invention.

Figure 9:
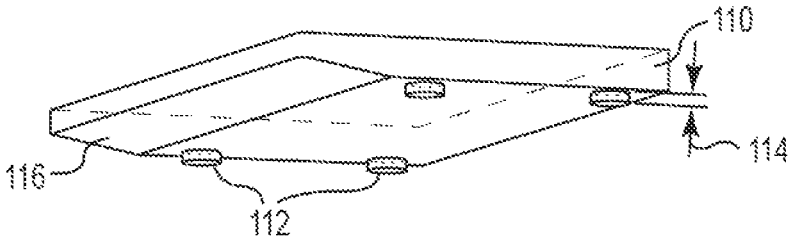
FIG. 9 is a perspective view of a dressing bar with spacers in accordance with an embodiment of the present invention.

FIG. 9 is a perspective view of an alternate dressing bar 110 with low friction pads 112 in accordance with an embodiment of the present invention. The low friction pads 112 control spacing between the dressing bar 110 and the substrate. The low friction pads 112 include a pre-defined height 114 that corresponds to the target height the abrasive particles extend above the substrate. The pads 112 assure a constant height during the entire dressing operation. It is envisioned that the low friction pads displace the abrasive particles during the embedding process and engage with the substrate.

In one embodiment, the pads 112 have heights of about 100 nanometers for use with abrasive particles having major diameters of about 200 nanometers to about 400 nanometers. The tapered region 116 forms an angle with respect to the flat region 118 of about 0.4 milli-radians.

Figure 10:
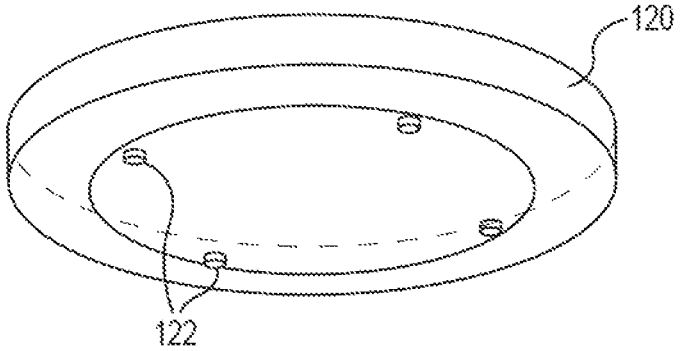
FIG. 10 is a perspective view of a circular dressing bar with spacers in accordance with an embodiment of the present invention.

FIG. 10 is a perspective view of a circular dressing bar 120 with low friction pads 122, as discussed above.

Figure 11:
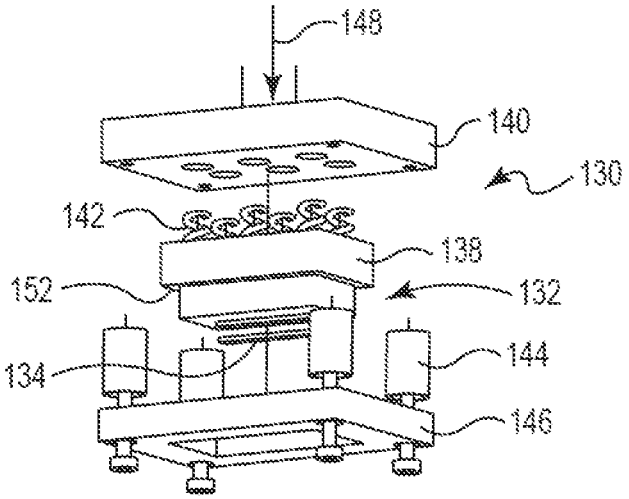
FIG. 11 is an exploded view of a gimballed dressing bar holder in accordance with an embodiment of the present invention.
Figure 12A:
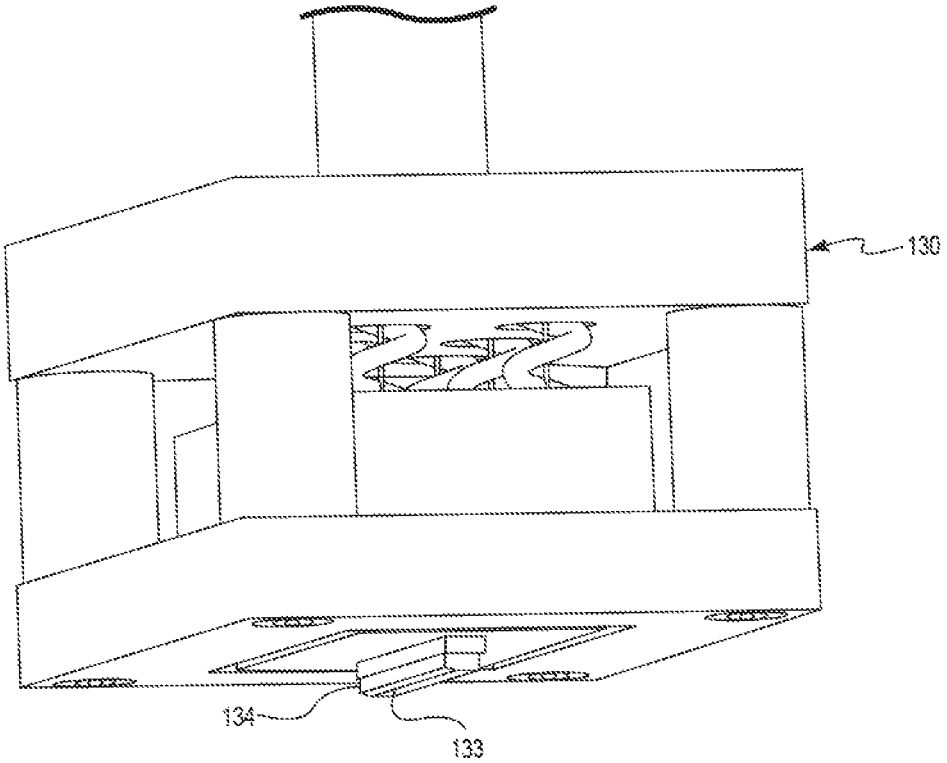
FIG. 12A is a side view of the gimballed dressing bar holder of FIG. 11.

FIGS. 11 and 12A illustrate a gimballed dressing bar assembly 130 in accordance with an embodiment of the present invention. Gimbal mechanism 132 allows the dressing bar 134 to be topography following with respect to the substrate 136 (see FIG. 13A). The gimbal mechanism 132 and preload structure 140 allows the dressing bar 134 to form a fluid bearing with a clearance determined by the system parameters. Once the clearance desired between the substrate 136 and the dressing bar 134 is achieved, abrasive particles are introduced at the interface. As used herein, "fluid bearing" refers generically to a fluid (i.e., liquid or gas) present at an interface between a dressing bar and a substrate that applies a lift force on the dressing bar. Fluid bearings can be generated hydrostatically, hydrodynamically, or a combination thereof.

Fluid bearings are fairly complex with a substantial number of variables involved in their design. The primary forces involved in a given fluid bearing are the gimbal structure 132 and the preload 148. The gimbal structure 132 applies both pitch and roll moments to the dressing bar 134. If the gimbal 132 is extremely stiff, the fluid bearing may not be able to form a pitch angle or a roll angle. The preload 148 and preload offset (location where the preload is applied) bias the fluid bearing toward the substrate.

Fluid bearing geometries on the active surface 133 of the dressing bar play a role in pressurization of a fluid bearing. Possible geometries include tapers, steps, trenches, crowns, cross curves, twists, wall profile, and cavities. Finally, external factors such as viscosity of the bearing fluid and linear velocity play an extremely important role in pressurizing bearing structures.

The dressing bar 134 is attached to bar holder 138. Bar holder 138 is engaged with preload fixture 140 by a series of springs 142. The bar holder 138 is captured between base plate 146 and a preload structure 140. Spacers 144 assure that the springs 142 are preloaded prior to engaging the dressing bar 134 with the plate 136. The springs 142 are preloaded to closely match the externally applied load 148. The springs 142 permit the bar holder to gimbal with respect to the preload structure 140.

In the preferred embodiment, externally applied load 148 is higher than the preload applied by the spring 142 on the gimbaled bar holder 138. The gimbaled bar holder 138 is suspended and free to gimbal and follow the run out and curvature of the substrate 136.

Figure 12B:
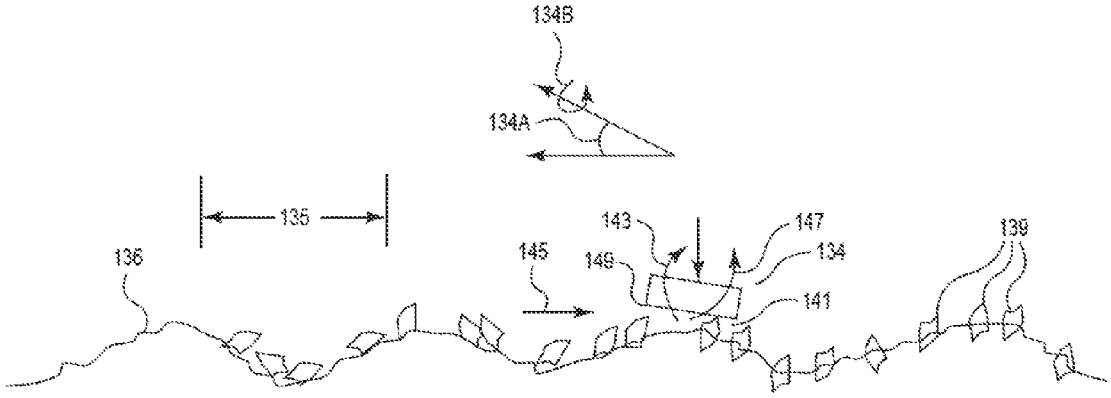
FIG. 12B is a conceptual view of a dressing bar interacting with a substrate in accordance with an embodiment of the present invention.

FIG. 12B is a schematic illustration of the engagement between the dressing bar 134 with substrate 136 in the topography following mode in accordance with an embodiment of the present invention. The dressing bar 134 is illustrated following the micrometer-scale and/or millimeter-scale wavelength 135 of the waviness on the substrate 136.

The leading edge 149 of the dressing bar 134 is raised above the substrate 136 due to hydrostatic and/or hydrodynamic lift force. In some embodiments, lubricant on the substrate 136 may contribute to the lift force. Discussion of hydrodynamic lift is provided in U.S. Pat. Nos. 7,93,805 and 7,218,478, which are hereby incorporated by reference.

Engagement of the dressing bar 134 with the substrate 136 is defined by pitch angle 134A and roll angle 134B of the dressing bar 134, and clearance 141 with the substrate 136. The gimbal 132 (see FIG. 11) provides the dressing bar 134 with roll and pitch stiffness that balance by the roll and pitch moments 143 generated by the hydrostatic and/or hydrodynamic lift.

The frictional forces 145 generated during interference embedding of the abrasive particles 139 cause a tipping moment 147 opposite to the moment 143, causing the leading edges 149 of the dressing bar 134 to move toward the substrate 136. The moment 143 generated by the lift is preferably greater than the moment 147 generated by frictional forces 145 at the interface with the abrasive particles 139, causing the abrasive particles to be embedded in the substrate 136 with a uniform height.

Figure 13A:
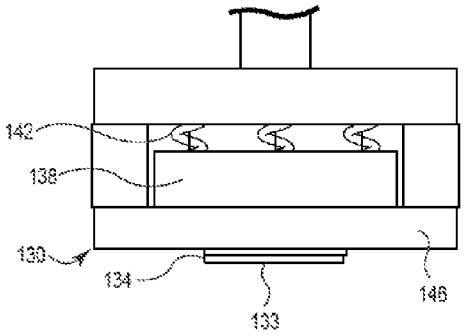
FIGS. 13A and 13B illustrate the gimballed dressing bar holder of FIG. 11 before and after engagement with a substrate in accordance with an embodiment of the present invention.
Figure 13B:
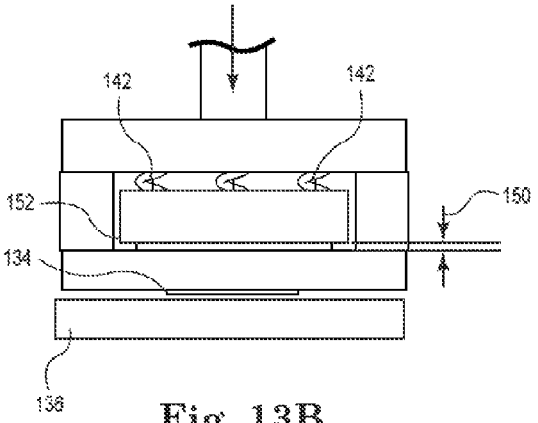
Figure 14:
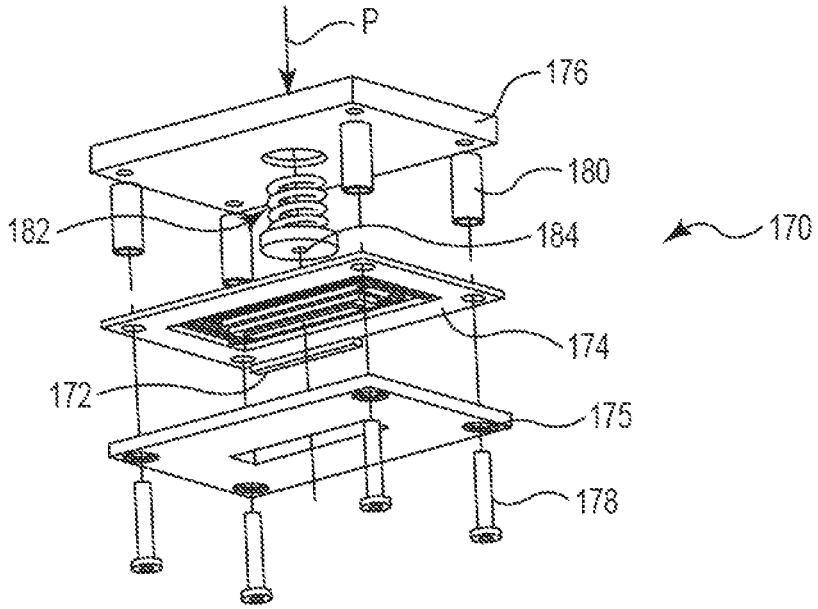
FIG. 14 is an exploded view of an alternate gimballed dressing bar holder in accordance with an embodiment of the present invention.

FIGS. 13A and 13B illustrate the gimballed dressing bar assembly 130 before and after engagement with substrate 136. As illustrated in FIG. 13A, the springs 142 bias the bar holder 138 into engagement with the base 146. The dressing bar 134 is at it maximum extension beyond the base 146.

As illustrated in FIG. 13B, the dressing bar 134 is engaged with the substrate 136. This engagement acts in opposition of the force of the springs 142, creating clearance 150 between shoulder 152 on the bar holder 138 and the base 146. The clearance 150 is preferably less than the diameter of the abrasive particles 139.

FIGS. 14 through 17 illustrate an alternate gimballed dressing bar assembly 170 in accordance with an embodiment of the present invention. Dressing bar 172 is attached to gimbal assembly 174, which is attached to preload structure 176 by fasteners 178 and spacers 180. The gimbal assembly 174 is captured between base plate 175 and the spacers 180.

Figure 15:
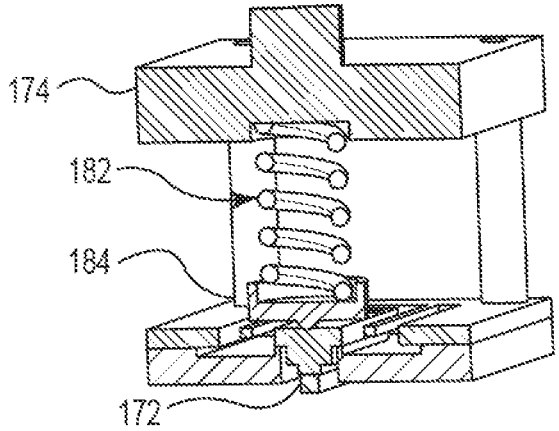
FIG. 15 is a sectional view of the gimballed dressing bar holder of FIG. 14.
Figure 16:
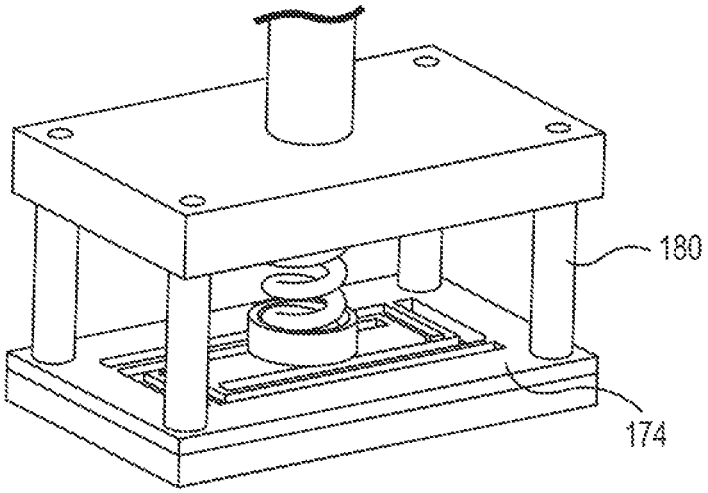
FIGS. 16 and 17 are perspective views of the gimballed dressing bar holder of FIG. 14.
Figure 17:
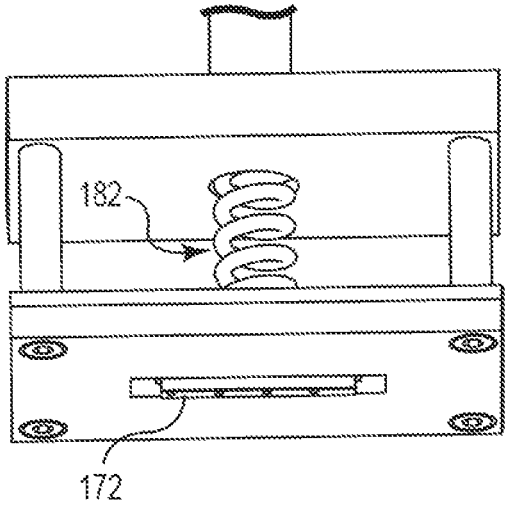

Spring assembly 182 transfers preload P from the preload structure 176 to the gimbal assembly 174. As best illustrated in FIG. 15, dimple 184 on spring assembly 182 applies a point load on the gimbal assembly 174. The dimple 184 decouples the preload from the roll and pitch stiffness of the dressing bar 172. The spring assembly 182 is maintained in compression between the preload structure 176 and the base plate 175. The gimbal assembly 174 allows the dressing bar 172 to move vertically, and in pitch and roll around the dimple 184. The dressing bar 172 meets all the conditions for establishing a fluid bearing with the substrate 192. The fluid bearing must be smaller than the diamonds in order to permit interference embedding of the diamonds into the plate 192.

Figure 18:
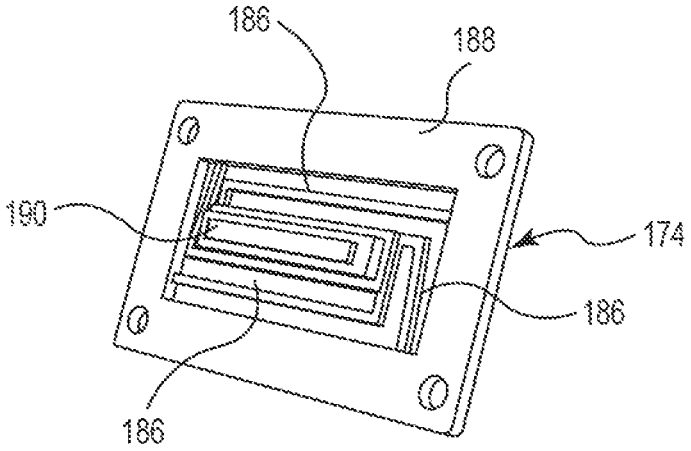
FIG. 18 is a perspective view of a gimbal assembly for the dressing bar holder of FIG. 14.

FIG. 18 is a perspective view of the gimbal assembly 174. A series of arms or segments 186 connect frame portion 188 to center portion 190. The dressing bar 172 can be integrally formed with the gimbal assembly 174 or can be a separate component attached thereto. The configuration of the segments 186 is well suited for in-plane deformation due to external load application. The displacement of the attached dressing bar 172 is substantially normal to the applied load with minimal twist, roll, or pitch, which is very desirable in order to cause the dressing bar 172 to rest substantially flat with respect to the substrate. In particular, the dressing bar 172 moves parallel to a plane defined by the applied load.

Figure 19:
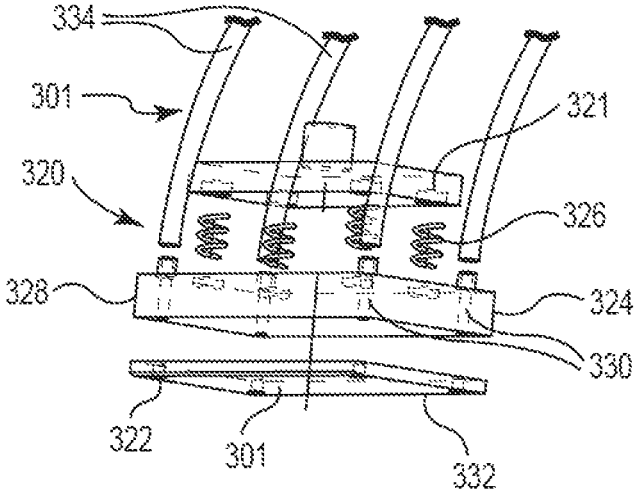
FIG. 19 is a perspective view of a dressing bar assembly with a hydrostatic fluid bearing in accordance with an embodiment of the present invention.
Figure 20:
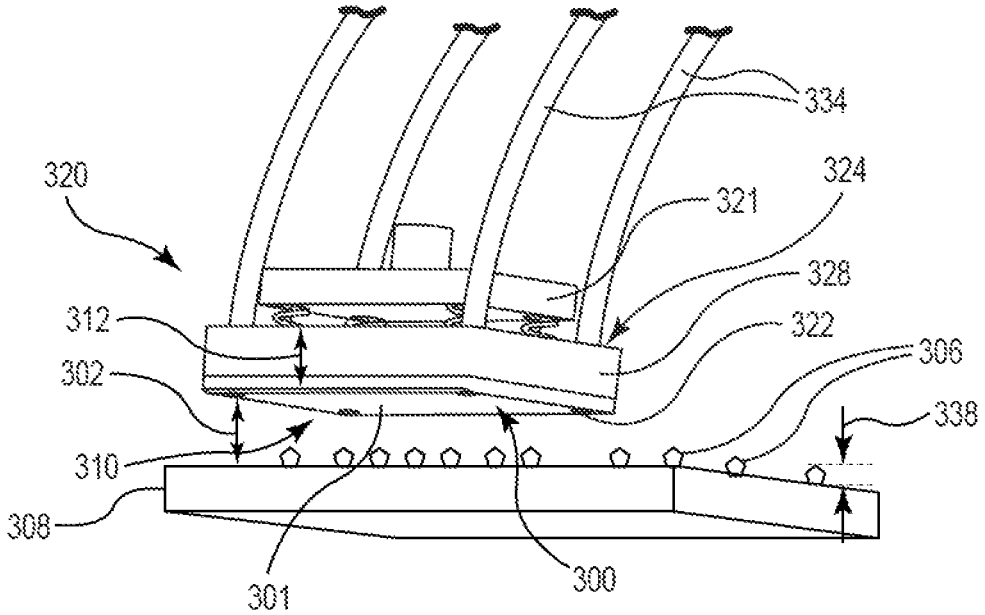
FIG. 20 is a perspective view of the dressing bar assembly of FIG. 19 engaged with an abrasive article in accordance with an embodiment of the present invention.
Figure 21:
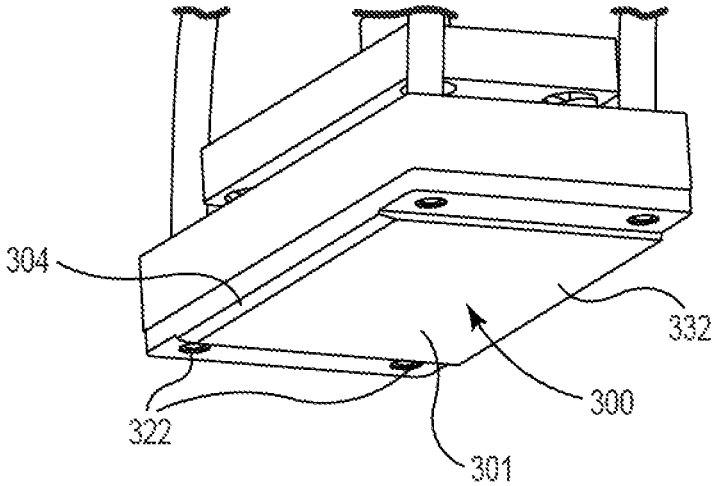
FIG. 21 is a perspective view of the dressing bar assembly of FIG. 19.
Figure 22:
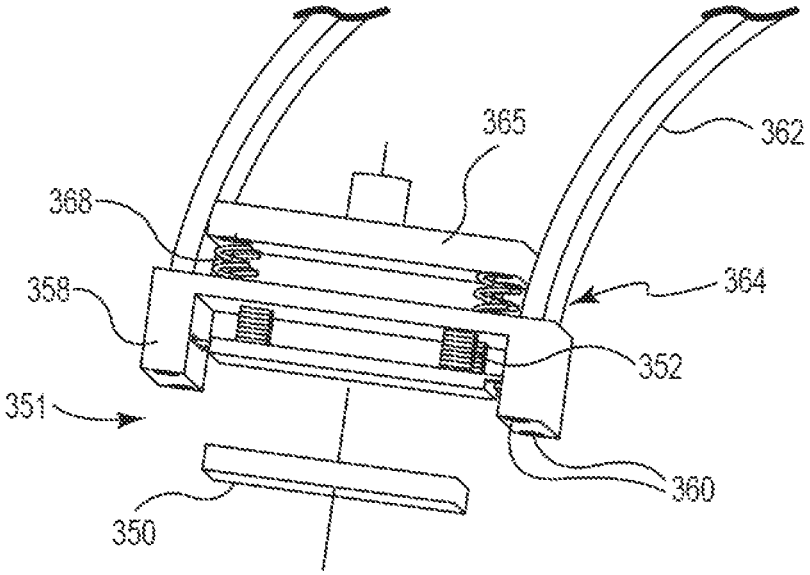
FIG. 22 is a perspective view of a dressing bar assembly with mechanical actuators in accordance with an embodiment of the present invention.
Figure 23:
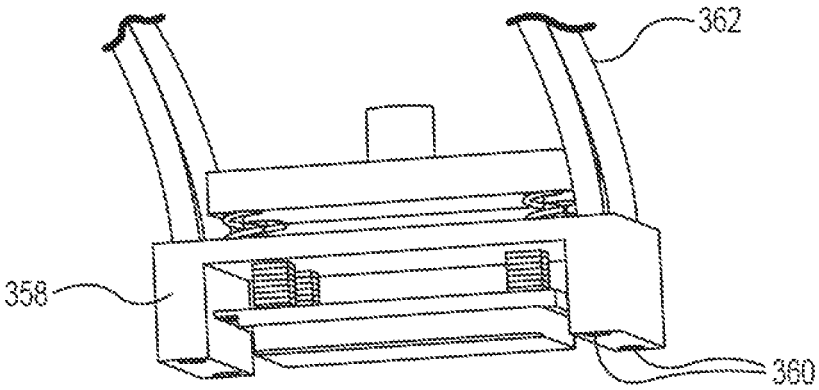
FIG. 23 is a perspective view of the dressing bar assembly of FIG. 22.
Figure 24:
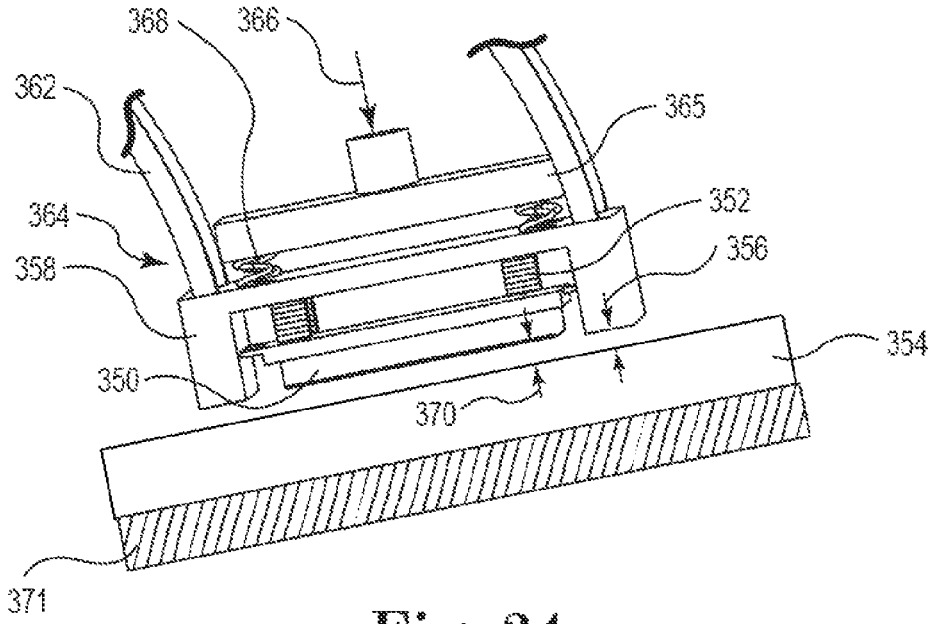
FIG. 24 is a perspective view of a dressing bar assembly of FIG. 22 engaged with an abrasive article in accordance with an embodiment of the present invention.

FIGS. 19-21 illustrate an embodiment of a dressing bar assembly 301 with a hydrostatic fluid bearing 302 in accordance with an embodiment of the present invention. The dressing bar 300 includes tapered leading edge 304 progressively interfering with abrasive particles 306 on substrate 308 (see FIG. 20).

As the abrasive particles 306 enter interface region 310 with the tapered leading edge 304 downward force 312 progressively increases, thus embedding the abrasive particles 306 into the substrate 308. The shape of the leading edge 304 can be linear or curvilinear depending on the clearance embedding force relationship desired during the abrasive embedding process.

As the substrate 308 rotates, the abrasive particles 306 are progressively driven downward as a function of the interference level with active surface 301. In an alternate embodiment, the substrate 308 is translated relative to the dressing bar 300 by an X-Y stage. The substrate 308 is optionally vibrated ultrasonically to facilitate penetration of the abrasive particles 306 into the plate 308.

The dressing bar 300 is suspended by a spring gimballing system 320 attached to support structure 321. Gimbal mechanism 324 includes a series of springs 326 that provide preload roll torque and pitch torque to buffer bar 328. The buffer bar 328 includes hydrostatic ports 330 in fluid communication with hydrostatic ports 322 on the dressing bar 300. The dressing bar 300 is attached to the buffer bar 328 to transfer the preload from the gimbal mechanism 324 to the hydrostatic fluid bearing 302.

Hydrostatic bearing system 320 includes a series of hydrostatic ports 322 formed in surface 332 of the dressing bar 300. The ports 322 are in fluid communication with delivery tubes 334 providing a source of compressed air. The hydrostatic lift system 320 provides the dressing bar 300 with roll, pitch and vertical stiffness, as well as controlling the spacing with the substrate 308.

A controller monitors gas pressure delivered to the slider dressing bar 300. Gas pressure to each of the four ports 322 is preferably independently controlled so that the pitch and roll of the slider dressing bar 300 can be adjusted. In another embodiment, the same gas pressure is delivered to each of the ports 322. While clean air is the preferred gas, other gases, such as for example, argon may also be used. The gas pressure is typically in the range of about 2 atmospheres to about 4 atmospheres. Once calibrated, the spacing between the dressing bar 300 and the substrate 308 can be precisely controlled, even while the dressing bar 300 follows the millimeter-scale and/or micrometer-scale waviness on the substrate 308.

The height of the abrasive particles 306 is determined by a spacing profile established by the active surface 301 of the dressing bar 300. The hydrostatic forces 302 supporting the dressing bar 300 counter the forces generated during embedding abrasive particles 306 as the substrate 308 is moved relative to the dressing bar 300.

The stiffness of the dressing bar 300 is determined by the relationship:

$$K=\Delta F/\Delta h$$

where ΔF is the change of load caused by a change in spacing Δh between the dressing bar and the substrate.

It is important to match the stiffness of the hydrostatic fluid bearing 302 to the change in spacing Δh. Note also that such relationship is generally nonlinear. The desired height of the diamonds 306 embedded in the substrate 308 is achieved by assuring a minimum clearance Δh between the plate and the dressing bar. The minimum clearance of the dressing bar 300 is set equal to the desired height 338 of the diamonds 306. The desired height 338 of the dressing bar 300 is adjusted by controlling the hydrostatic pressure, Ps, leading to a desired spacing 338 between the dressing bar and the plate. A similar relationship can be drawn for pitch and roll stiffness.

Multiple design configurations can be envisioned for the dressing bar 300. Hydrostatic ports 322 can be machined into the dressing bar 300 or attached to the dressing bar 300 via a fixture.

A fly height tester can be used to determine the relationship between the applied load on the dressing bar and the spacing between the dressing bar and the substrate. By varying the external pressure on the hydrostatic ports fabricated onto the dressing bar, a desired minimal clearance matching the desired abrasive height and pitch and roll angles can be established for each dressing bar.

Alternate hydrostatic slider height control devices are disclosed in commonly assigned U.S. Provisional Patent Application Ser. No. 61/220,149 entitled Constant Clearance Plate for Embedding Diamonds into Substrates, filed Jun. 24, 2009 and Ser. No. 61/232,425 entitled Dressing bar for Embedding Abrasive Particles into Substrates, which are hereby incorporated by reference. A mechanism for creating a hydrostatic air bearing for a gimbaled structure is disclosed in commonly assigned U.S. Provisional Patent Application Ser. No. 61/172,685 entitled Plasmon Head with Hydrostatic Gas Bearing for Near Field Photolithography, filed Apr. 24, 2009, which is hereby incorporated by reference.

Figure 25:
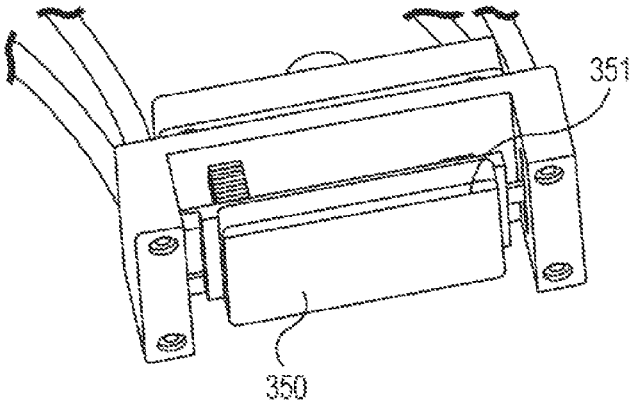
FIG. 25 is a perspective view of a dressing bar assembly of FIG. 22.

FIGS. 22 through 25 illustrate a mechanically actuated dressing bar assembly 351 attached to a hydrostatic bearing mechanism 358 in accordance with an embodiment of the present invention. The hydrostatic bearing mechanism 358 permits dressing bar 350 to be topography following with respect to the substrate 354 (see FIG. 24) to achieve a constant spacing 356. Spacing 370 between dressing bar 350 and substrate 354 can be controlled independently from spacing 356 with the hydrostatic bearing mechanism 358. As best illustrated in FIG. 25, the dressing bar 350 includes taper 351.

The hydrostatic bearing mechanism 358 includes a series of hydrostatic ports 360 in fluid communication with delivery tubes 362 connected to a source of compressed air. The hydrostatic ports 360 maintain the spacing 356 between the hydrostatic bearing mechanism 358 and the substrate 354.

Gimbal mechanism 364 includes a rigid support structure 365 that supports springs 368 providing preload force 366 with pitch and roll movement to the hydrostatic bearing mechanism 358. The springs 368 are organized to minimize the distortion of the hydrostatic bearing mechanism 358.

The dressing bar 350 is attached to a hydrostatic bearing mechanism 358 by actuators 352. The attachment between the dressing bar 350 and the actuators 352 is critical for advancing the dressing bar 350 to the substrate 354 and achieving a desired spacing profile 370. The actuators 352 can be controlled independently to adjust clearance, pitch, roll, and yaw of the dressing bar 350 relative to the hydrostatic bearing mechanism 358.

In operation, the actuators 352 advance the dressing bar 350 toward the substrate 354, while the hydrostatic bearing mechanism 358 maintains a constant spacing 356. The end effectors of the actuators 352 control push/pull the gimballing mechanism 364. As the actuators 352 are pushing and pulling the attitude including pitch, roll, and vertical location of the dressing bar 350 is mechanically controlled to a desired value. A prescribed height 370 of the dressing bar 350 with respect to the substrate 354 is controlled via the actuators 352.

Motion of the dressing bar 350 relative to the substrate 354 is controlled by translation mechanism 371. Translation mechanism 371 can be a rotary table, an X-Y stage, an orbital motion generator, an ultrasonic vibrator, or some combination thereof.

Figure 26:
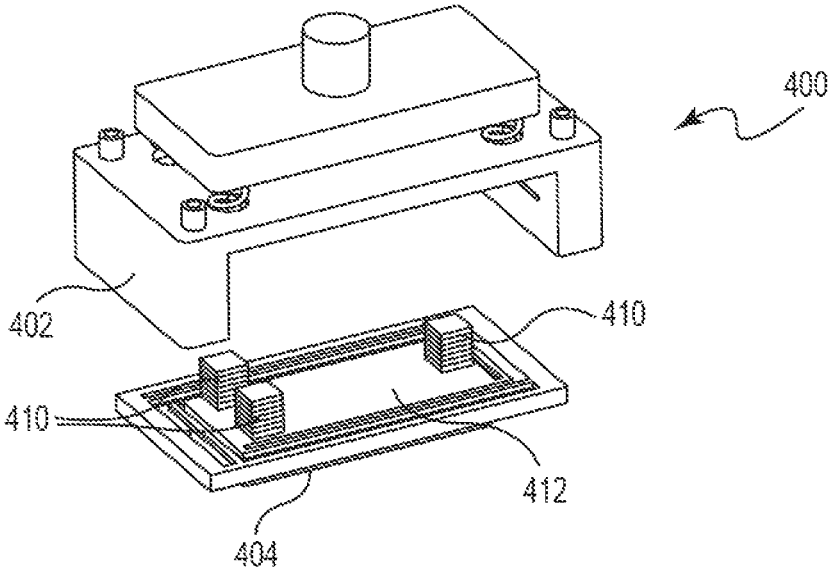
FIG. 26 is an exploded view of an alternate dressing bar assembly with mechanical actuators in accordance with an embodiment of the present invention.
Figure 27:
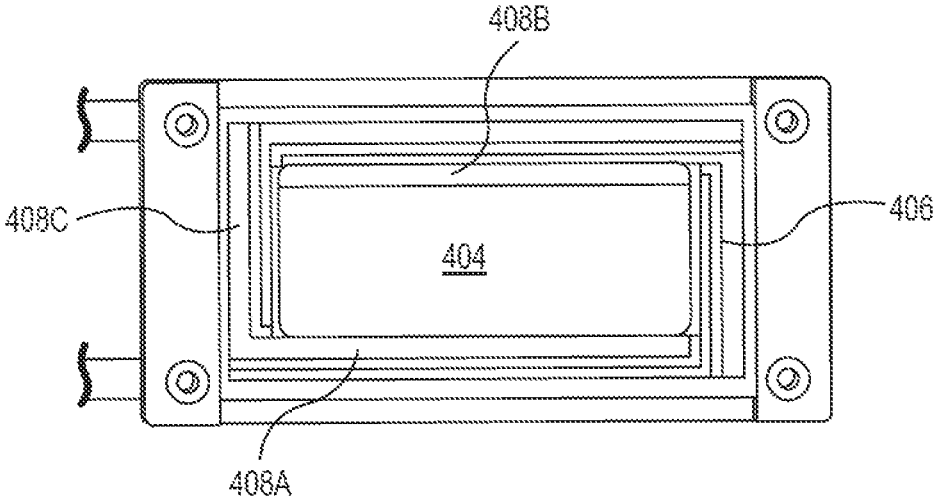
FIG. 27 is a plan view of a gimbal assembly for the dressing bar assembly of FIG. 26.

FIGS. 26 and 27 illustrate an alternate mechanically actuated dressing bar assembly 400 attached to a hydrostatic bearing mechanism 402 in accordance with an embodiment of the present invention. The hydrostatic bearing mechanism 402 operates as discussed in connection with FIGS. 21-25.

The dressing bar 404 is attached to a gimbal assembly 406. Gimbal assembly 406 includes a series of spring arms 408A, 408B, 408C (collectively "408") that permit the dressing bar 404 to move through pitch, roll, and yaw. The spring arms 408 minimize twist of the hydrostatic bearing mechanism 402, while allowing for a substantially linear axial motion during axial motion of actuators 410.

The gimbal assembly 406 is attached to the hydrostatic bearing mechanism 402. The actuators 410 are interposed between the hydrostatic bearing mechanism 402 and pad 412 on the gimbal assembly 406. The actuators 410 advance the dressing bar 404 toward the substrate as discussed in connection with FIG. 24.

Figure 28:
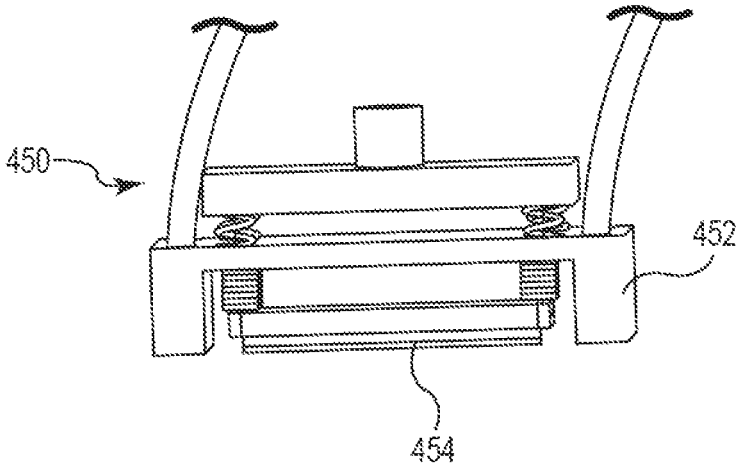
FIG. 28 is a perspective view of an alternate dressing bar assembly with mechanical actuators in accordance with an embodiment of the present invention.
Figure 29:
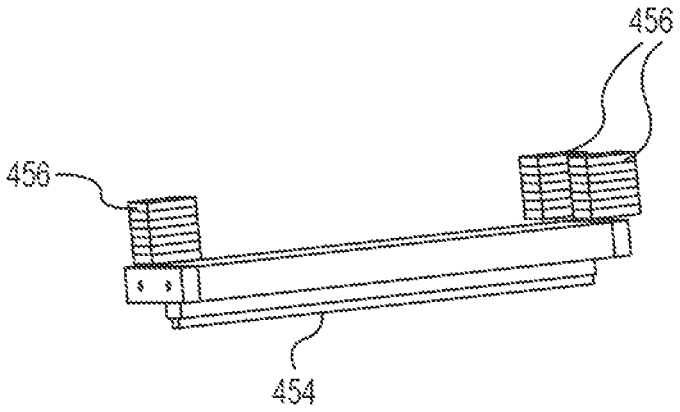
FIG. 29 is a perspective view of the dressing bar and mechanical actuators of FIG. 28.
Figure 30:
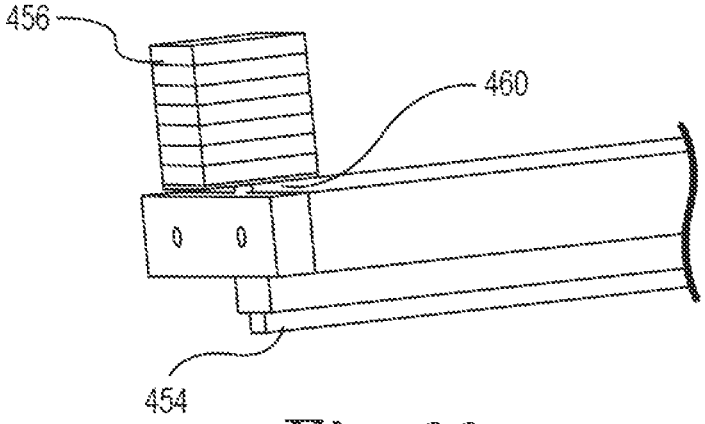
FIG. 30 is an enlarged view of an interface between the dressing bar and the mechanical actuators of FIG. 28.

FIGS. 28-30 illustrate an alternate mechanically actuated dressing bar assembly 450 attached to a hydrostatic bearing mechanism 452 in accordance with an embodiment of the present invention. The hydrostatic bearing mechanism 452 operates as discussed in connection with FIGS. 21-25.

Dressing bar 454 is attached to the hydrostatic bearing mechanism 452 using three actuators 456 arranged in a three-point push configuration. Ball and socket mechanism 460 is provided at the interface between micro-actuators 456 and the dressing bar 454. The micro-actuators may be piezoelectric, heaters to create thermal deformation, or a variety of other micro-actuators known in the art.

The ball and socket mechanism 460 minimizes vibrations and stresses transferred to the hydrostatic bearing mechanism 452. The ball and socket mechanism 460 allows the hydrostatic bearing mechanism 452 to rotate freely while being attached to the micro-actuators 456. The ball and socket mechanism 460 allow for a true planar relationship between the micro-actuators 456 and the hydrostatic bearing mechanism 452.

The ball socket mechanism 460 preferably introduces minimal slack to avoid any undesired motion. The interference fit generates frictional forces enhancing the stability of the dressing bar 454 under external excitations.

Figure 31:
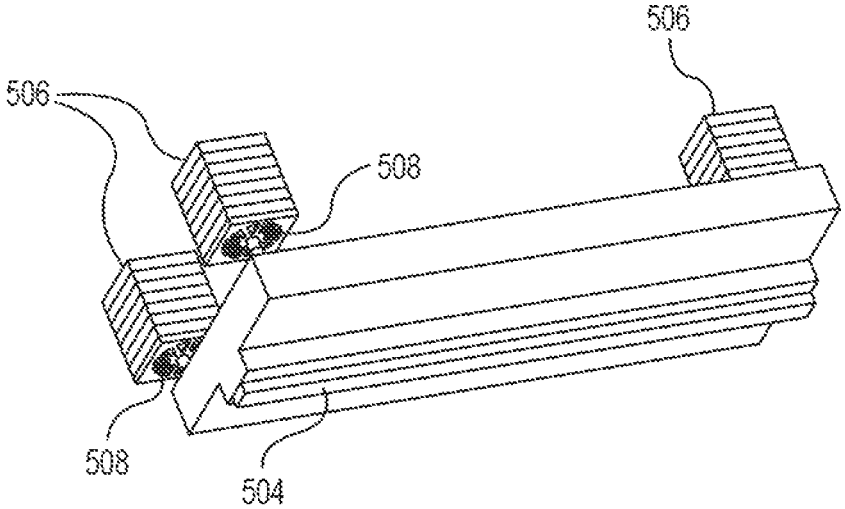
FIG. 31 is a perspective view of a resilient interface between the dressing bar and the mechanical actuators in accordance with an embodiment of the present invention.
Figure 32:
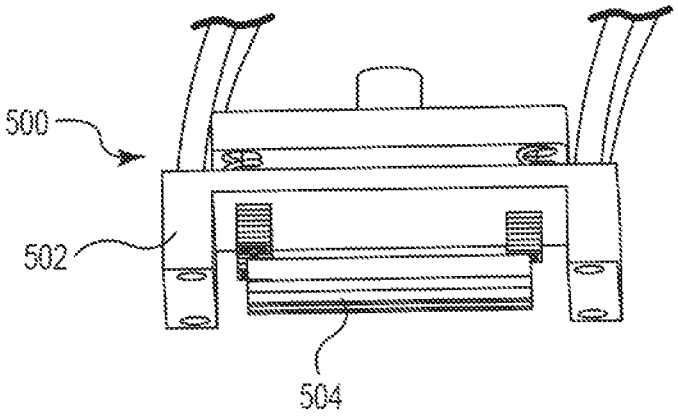
FIG. 32 is a perspective view of the dressing bar assembly and mechanical actuators of FIG. 31.
Figure 33:
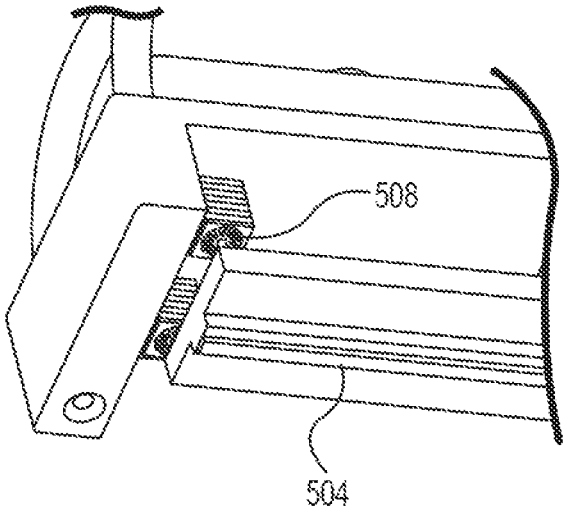
FIG. 33 is a perspective view of the dressing bar assembly and mechanical actuators of FIG. 31.

FIGS. 31-33 illustrate an alternate mechanically actuated dressing bar assembly 500 attached to a hydrostatic bearing mechanism 502 in accordance with an embodiment of the present invention. The hydrostatic bearing mechanism 502 operates as discussed in connection with FIGS. 21-25.

Dressing bar 504 is attached to the hydrostatic bearing mechanism 502 using three actuators 506 arranged in a three-point push configuration. An elastic member 508 is located at interface 510 between the actuators 506 and the dressing bar 504. The elastic members 508 permit the dressing bar 504 to rotate relative to the actuators 506.

A fly height tester can be used to determine the relationship between the applied load on the dressing bar and the spacing between the dressing bar and the substrate. By varying the external pressure on the hydrostatic ports in the hydrostatic bearing mechanism, a desired minimal clearance matching the desired abrasive height and pitch and roll angles can be established for each dressing bar.

Acoustic emission can also be used to determine contact between the dressing bar and the substrate by energizing the actuators. A transfer function between the actuators and the gimballing mechanism can be established numerically or empirically to determine the displacement actuation relationship.

Figure 34:
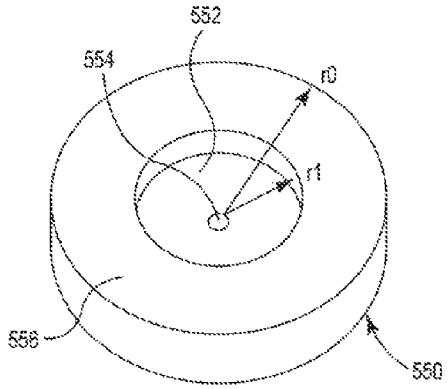
FIG. 34 is a perspective view of an alternate button bearings in accordance with an embodiment of the present invention.

FIG. 34 illustrates a hydrostatic button bearing 550 with cavity 552 having port 554 and an outer annular active surface 556 in accordance with an embodiment of the present invention. In one embodiment, R0 is about 2 millimeters and the ratio of R1/R0 is about 0.87. The preload on the hydrostatic bearing is about 8.8 Newtons.

Figure 35:
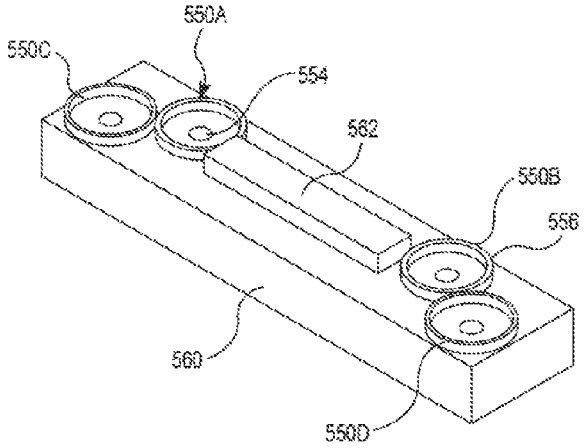
FIG. 35 is a perspective view of a dressing bar with the button bearings of FIG. 34 in accordance with an embodiment of the present invention.

FIG. 35 is a perspective view of dressing bar 560 incorporating four of the button bearings 550A, 550B, 550C, 550D ("550") of FIG. 34, in accordance with an embodiment of the present invention. Assuming a flow rate of about 10 milliliters/minute is delivered to the port 554, the pressure regulators generate a hydrostatic pressure about 0.8 Mega Pascals (MPa) in order to maximize the load carrying capacity. The resulting hydrostatic bearing has a clearance of about 1 micrometers measured between the active surfaces 556 and the substrate.

Figure 36:
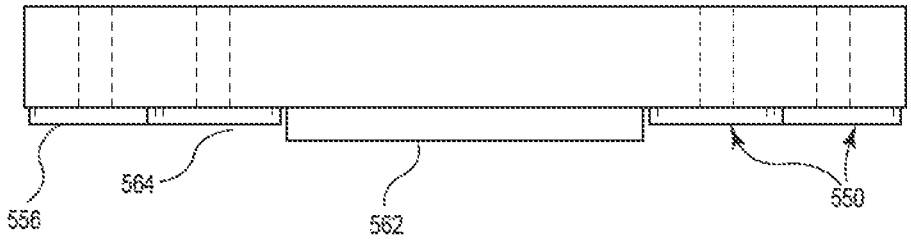
FIG. 36 is a side view of the dressing bar of FIG. 35.

As best illustrated in FIG. 36, the active surface 562 of dressing bar 560 extends a distance 564 of about 800 nanometers to about 900 nanometers above the active surfaces 556 of the button bearings 550, resulting in a spacing of the active surface 562 above the substrate of about 100 nanometers to about 200 nanometers. The pressure at leading edge button bearings 550A, 550B is preferably greater than at trailing edge button bearings 550C, 550D in order to pitch the dressing bar 560.

Figure 37:
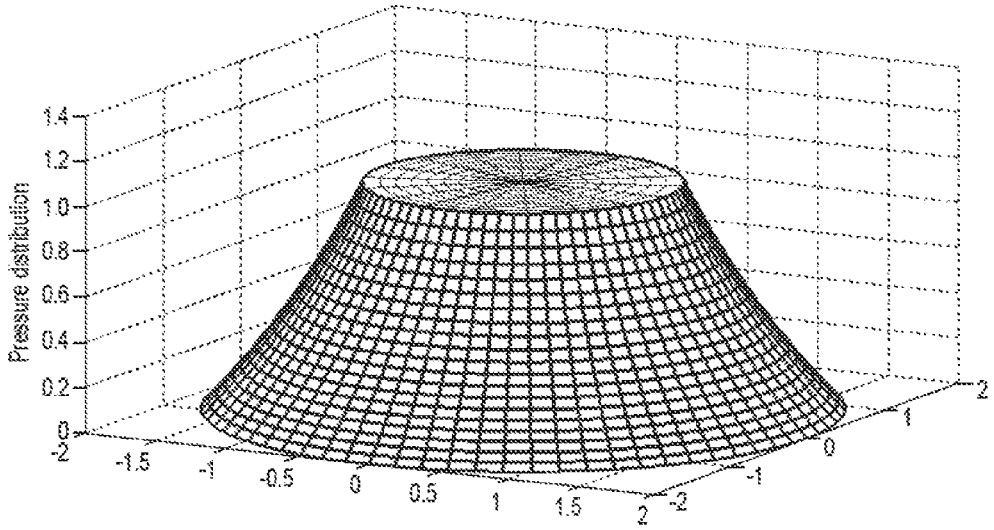
FIG. 37 is a pressure profile for the button bearing of FIG. 34.

FIG. 37 shows a shape of the pressure distribution with a flat top pressure corresponding to the externally delivered pressure in the cavity 552 and the decaying pressure distribution along the bearing surface 554.

Figures 38A, 38B:
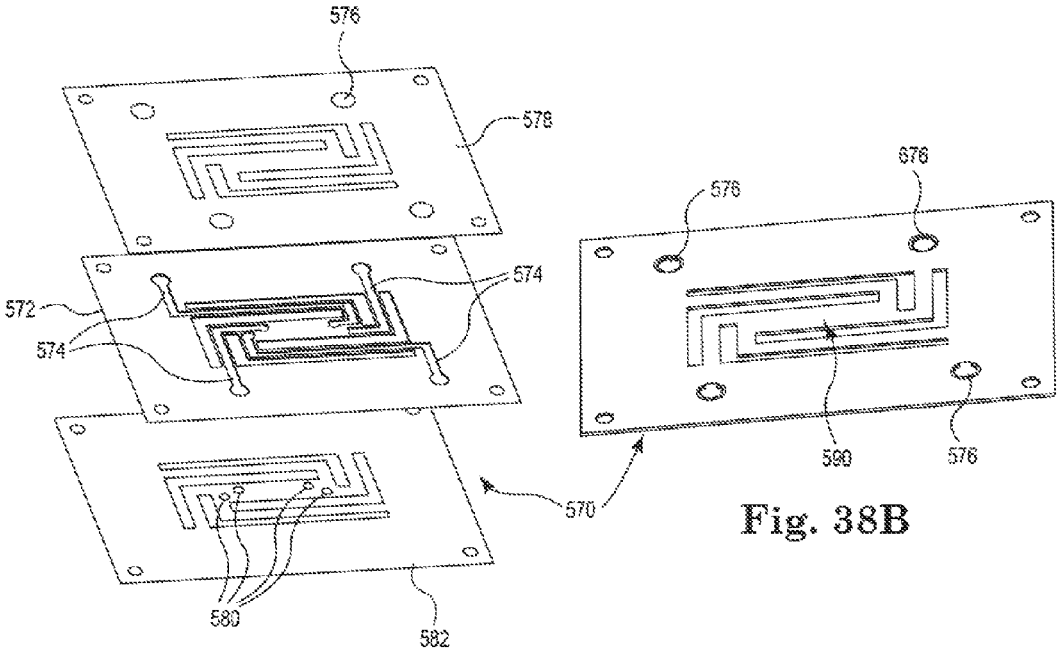
FIGS. 38A and 38B illustrate a multi-layered gimbal assembly in accordance with an embodiment of the present invention.

FIG. 38A illustrates a multi-layered gimbal assembly 570 in accordance with an embodiment of the present invention. In the illustrated embodiment, center layer 572 includes traces 574 that deliver compressed air from inlet ports 576 in the top layer 578 to exit ports 580 on the bottom layer 582. The exit ports 580 are fluidly coupled to the ports 554 on the button bearings 550. As best illustrated in FIG. 38B, the inlet ports 576 are offset and mechanically decoupled from the gimbal mechanism 590.

Figure 39:
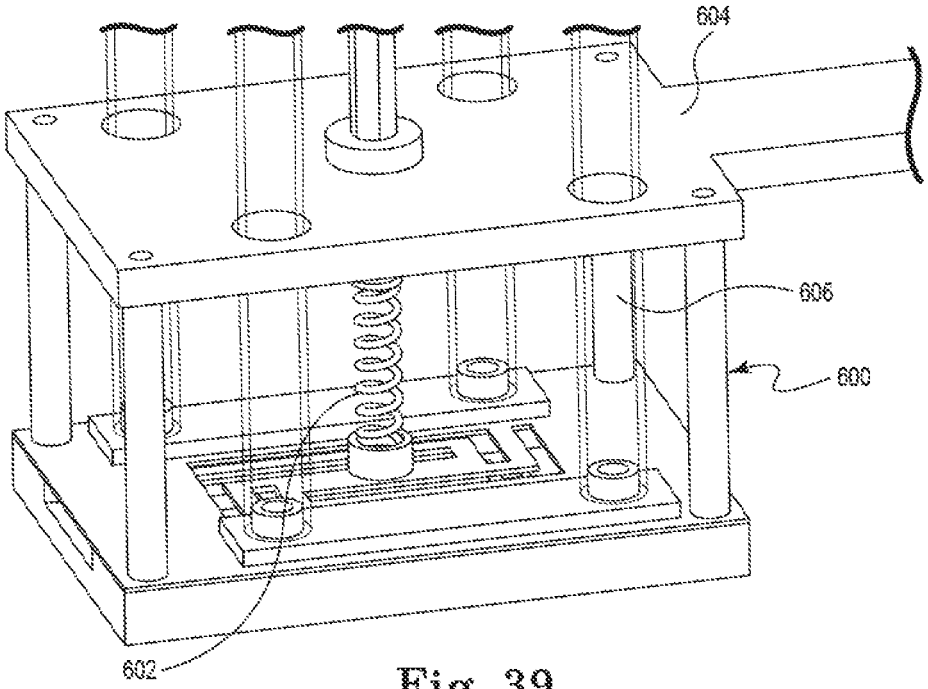
FIGS. 39 and 40 are perspective views of a dressing bar assembly in accordance with an embodiment of the present invention.
Figure 40:
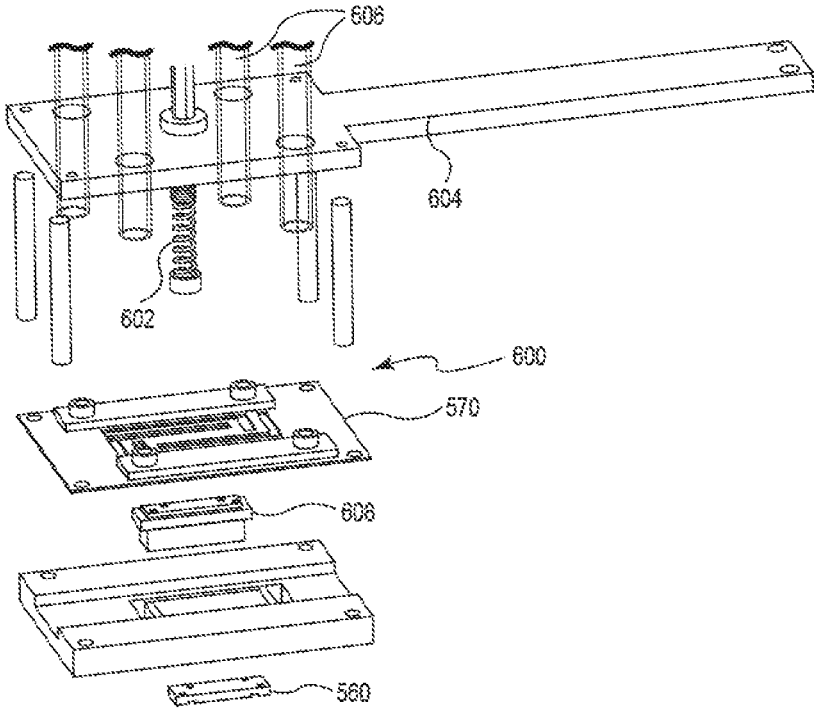

FIGS. 39 and 40 are perspective views of a dressing bar assembly 600 in accordance with an embodiment of the present invention. Spring load mechanism 602 delivers a preload of about 40 Newtons from the preload structure 604 to bar holder 608 and dressing bar 560. Tubes 606 deliver compressed air to each of the inlet ports 576 of the gimbal assembly 570.

Figure 41A:
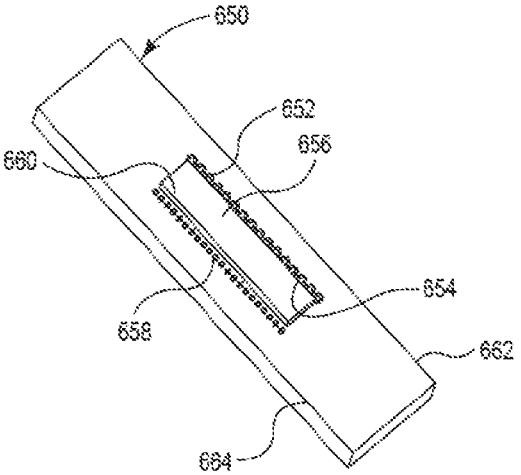
FIGS. 41A and 41B are perspective views of a dressing bar with an array of the hydrostatic ports in accordance with an embodiment of the present invention.
Figure 41B:
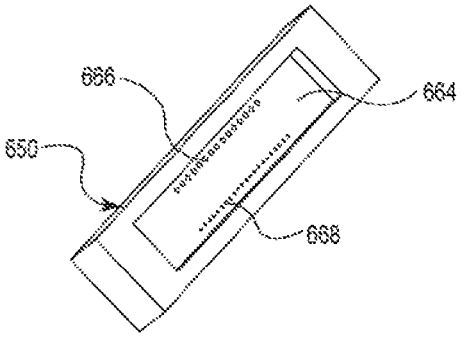

FIGS. 41A and 41B are front and rear perspective views of an alternate dressing bar 650 in accordance with an embodiment of the present invention. A first set of hydrostatic ports 652 are located adjacent to leading edge 654 of active surface 656. A second set of hydrostatic ports 658 are located adjacent to trailing edge 660 of active surface 656. The plurality of hydrostatic ports 652, 658 allows for a better averaging of the substrate waviness and a better overall topography following. The plurality of ports 652, 658 results in lower flow per port and allows for more accurate clearance control.

The hydrostatic ports in the first set 652 are optionally smaller than the hydrostatic ports in the second set 658 so leading edge 662 can be positioned higher above the surface than trailing edge 664. The pressure in cavity 664 is generally uniform so the flow is delivered uniformly to each of the ports 666 and 668. Variations in incoming flow is seen by all the bearings 652, 658 causing minimal change in pitch and roll of the dressing bar 650, although the overall spacing of the dressing bar 650 will be effected by the changes in the flow. In an alternate embodiment, the cavity 664 is divided so one flow controller supplies the ports 652 and another flow controller supplies the ports 658.

Figure 42:
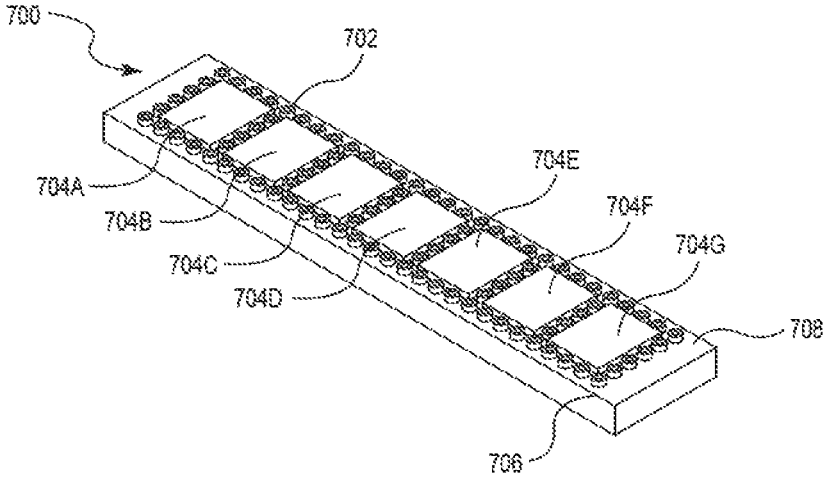
FIG. 42 is a perspective view of an alternate dressing bar with a plurality of active surfaces surrounded by hydrostatic ports in accordance with an embodiment of the present invention.

FIG. 42 is a perspective view of an alternate dressing bar 700 in accordance with an embodiment of the present invention. A plurality of hydrostatic ports 702 surround the plurality of active surfaces 704A-704G ("704") on the dressing bar 700. The plurality of hydrostatic ports 702 reduce the flow per port and compensate for the incoming flow variations. The configuration of the ports 702 around the active surfaces 704 averages the response of the dressing bar 700 to variations in micrometer-scale and millimeter-scale topography of the substrate. In essence, the dressing bar 700 acts as a mechanical filter reducing clearance variations due to changes in the topography of the substrate. Manufacturing tolerances and variations in the dressing bar 700 are also averaged and randomized leading to less spacing variations. Flow variation causes a proportional change of spacing at the leading edge 706 and the trailing edge 708, serving to maintain the pitch or attitude of the dressing bar 700.

Figure 43:
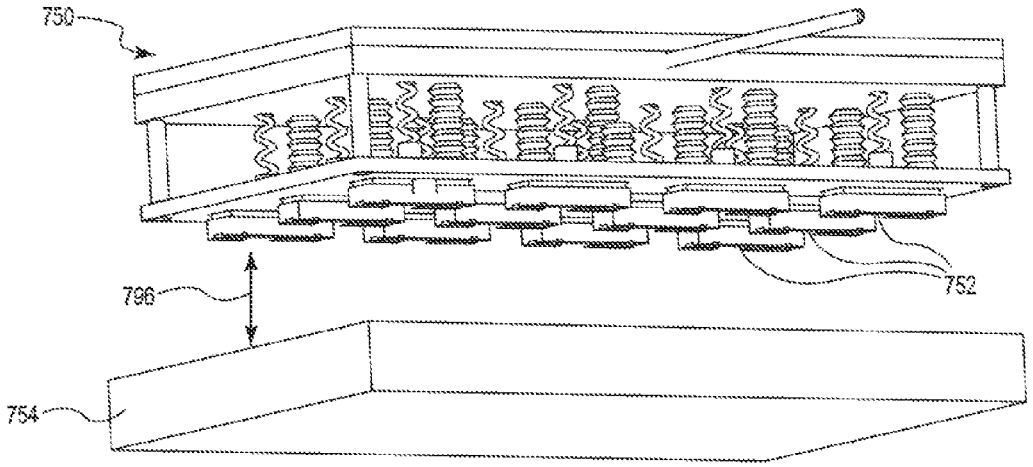
FIG. 43 is a perspective view of a dressing bar assembly with an array of individually gimballed hydrostatic dressing bars in accordance with an embodiment of the present invention.
Figure 44:
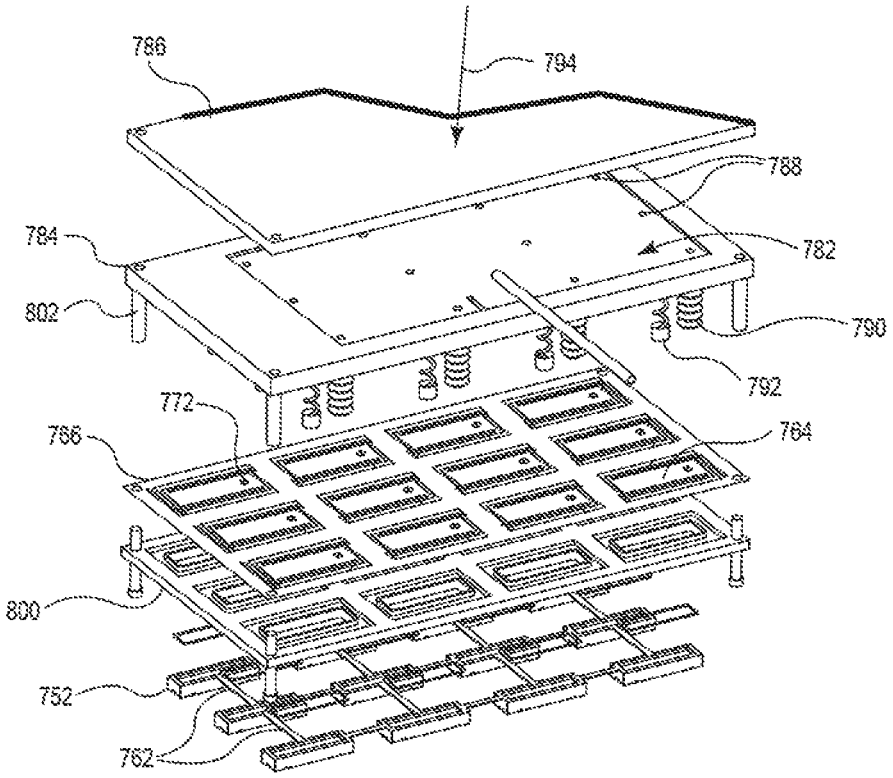
FIG. 44 is an exploded view of the dressing bar assembly of FIG. 43.

FIG. 43 is a bottom perspective view of dressing bar assembly 750 with an array of dressing bar 752 in accordance with an embodiment of the present invention. FIG. 44 is an exploded view of the dressing bar assembly of FIG. 43. Alternatively, the dressing bars can be arranged in a circular array, an off-set pattern, or a random pattern.

Abrasive particle embedding is accomplished by relative motion between the dressing bar assembly 750 and the substrate 754, such as linear, rotational, orbital, ultrasonic, and the like. In one embodiment, that relative motion is accomplished with an ultrasonic actuator such as disclosed in commonly assigned U.S. Provisional Patent Application Ser. No. 61/232,525, entitled Method and Apparatus for Ultrasonic Polishing, filed Aug. 10, 2009, which is hereby incorporated by reference.

Figure 45A:
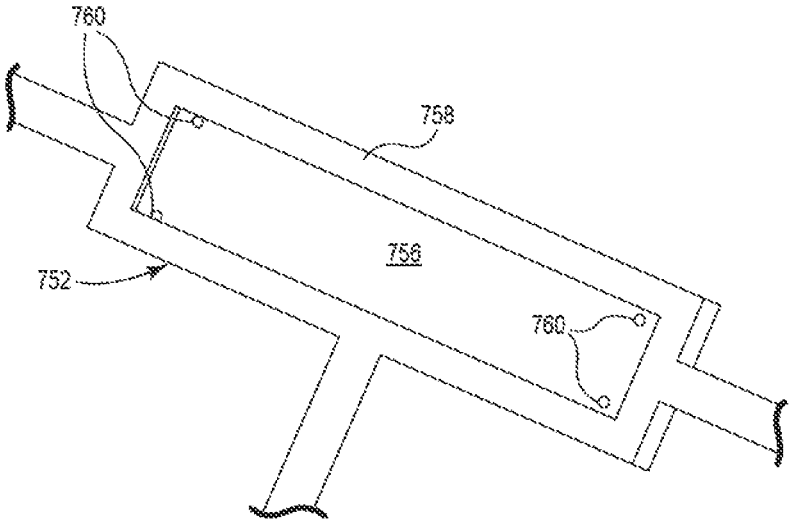
FIG. 45A is a rear view of an individual dressing bar for the dressing bar assembly of FIG. 43.

In the illustrated embodiment, each dressing bar 752 is hydrostatically controlled. FIG. 45A illustrates a top view of an individual dressing bar 752. Pressure cavity 756 is fabricated on the back surface 758 of the dressing bar 752 that acts as a plenum for the delivery of pressurized gas out through the hydrostatic pressure ports 760.

Figure 45B:
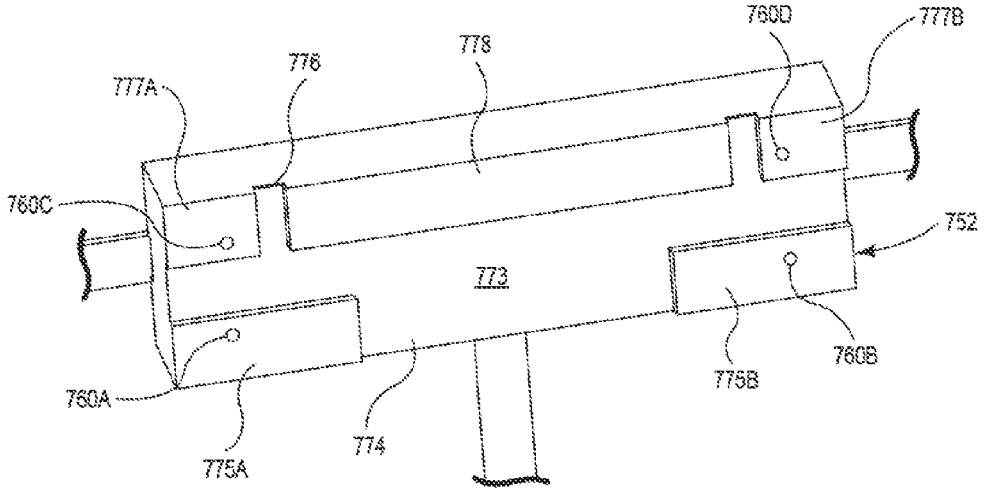
FIG. 45B is a front view of the dressing bar assembly of FIG. 43 in accordance with one embodiment of the present invention.

FIG. 45B illustrates an embodiment of dressing bar 752 with both hydrostatic and hydrodynamic fluid bearing capabilities designed into bottom surface 773 in accordance with an embodiment of the present invention. Leading edge 774 of the dressing bar 752 includes a pair of fluid bearing features 775A, 775B (collectively "775") each with at least one associated pressure port 760A, 760B. Trailing edge 776 also includes fluid bearing features 777A, 777B (collectively "777") and associated hydrostatic pressure ports 760C, 760D. Active surface 778 on the trailing edge 776 enhance the stability of the dressing bar 752 at the interface with a abrasive particles.

The fluid bearing features 777 on the trailing edge 776 have less surface area than the fluid bearing features 775 at the leading edge 774. Consequently, the leading edge 774 typically flies higher than the trailing edge 776, which sets the pitch of the dressing bar 752 relative to the substrate 754 (see, e.g., FIG. 43). The trailing edge 776 is typically designed to be in interference with the abrasive particles on the substrate 754. Both leading edge and trailing edge fluid bearing features 775, 777 contribute to holding the dressing bar 752 at a desired clearance 796 from the substrate 754 and controlling the amount of interference with abrasive particles. It is also possible to control the pressure applied to the hydrostatic pressure ports 760 to increase or decrease the pitch of the dressing bar 752.

The hybrid dressing bar 752 can operate with a hydrostatic fluid bearing and/or a hydrodynamic fluid bearing. The hydrostatic pressure ports 760 apply lift to the dressing bar 752 prior to movement of the substrate 754. The lift permits clearance 796 to be set before the substrate 754 starts to move. Consequently, the high preload 794 does not damage the substrate 754 during start-up. Once the substrate 754 reaches its safe speed and the hydrodynamic fluid bearing is fully formed, the hydrostatic fluid bearing can be reduced or terminated. The procedure can also be reversed at the end of the embedding process. The hybrid dressing bar 752 is particularly well suited to prevent damage to Tin substrates. Tin is a very soft metal and precautions are needed to avoid damage and tear out of the Tin coating during start-up and wind-down.

In another embodiment, both the hydrostatic and hydrodynamic fluid bearings are maintained during at least a portion of the embedding process. The pressure ports 760 can be used to supplement the hydrodynamic bearing during the embedding process. For example, the pressure ports 760 may be activated to add stiffness to the fluid bearing during initial passes of the dressing bar 752 over the substrate 754. After the abrasive particles are substantially uniformly embedded, the hydrostatic portion of the fluid bearing may be reduced or terminated to reduce the stiffness. The pressure ports 760 can also be used to adjust or fine tune the attitude or clearance of the dressing bar 752 relative to the substrate 754. Hybrid dressing bars can be used alone or in an array. A single hybrid dressing bar 50 is illustrated in FIG. 5A.

As best illustrated in FIG. 44, the dressing bars 752 are preferably formed in an array separated by spacing structures 762. In one embodiment, the dressing bars 752 and spacing structures 762 are injection molded from a polymeric material to form an integral structure. Alternatively, discrete dressing bars 752 can be bonded or attached to the gimbal mechanisms 764 on the gimbal assembly 766. The dressing bars 752 can be arranged in a regular or random pattern.

Figure 46:
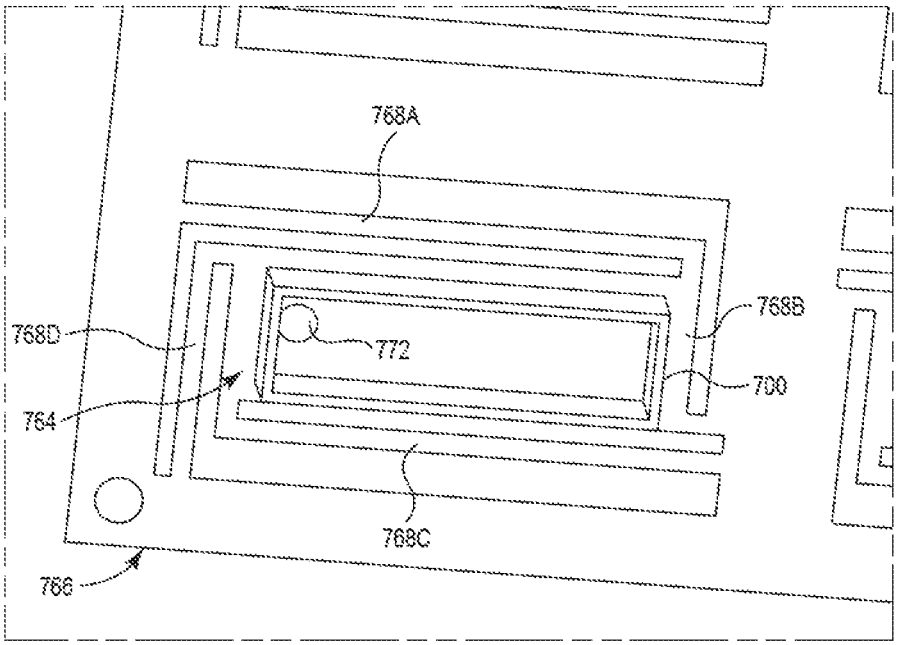
FIG. 46 is a top view of a gimbal assembly for the dressing bar assembly of FIG. 43.

As illustrated in FIG. 46, gimbal assembly 766 includes an array of the gimbal mechanisms 764. Each gimbal mechanism 764 includes four L-shaped springs 768A, 768B, 768C, 768D (collectively "768") that suspend the dressing bars 752 above the substrate 754 in accordance with an embodiment of the present invention. Box-like structure 770 is optionally fabricated on each gimbal mechanism 764 to help align the dressing bars 752. The box-like structure 770 also includes a port 772 that delivers the pressurized gas to the cavity 756 in the dressing bars 752 and out the hydrostatic pressure ports 760.

As best illustrated in FIG. 44, external pressure source 780 delivers pressurized gas (e.g., air) to plenum 782 in preload structure 784. Cover 786 is provided to enclose the plenum 782. A plurality of hydrostatic pressure ports 788 in the plenum 782 are fluidly coupled to the hydrostatic pressure ports 772 on the gimbal mechanism 764 by bellows couplings 790.

An adhesive layer (not shown) attaches the dressing bars 752 to the gimbal box-like structure 770.

Springs 792 transfer the preload 794 from the preload structure 784 to each of the gimbal mechanisms 764. The externally applied load 794 and the external pressure control the desired spacing 796 between the dressing bars 752 and the substrate 754 (see FIG. 43).

Figure 47:
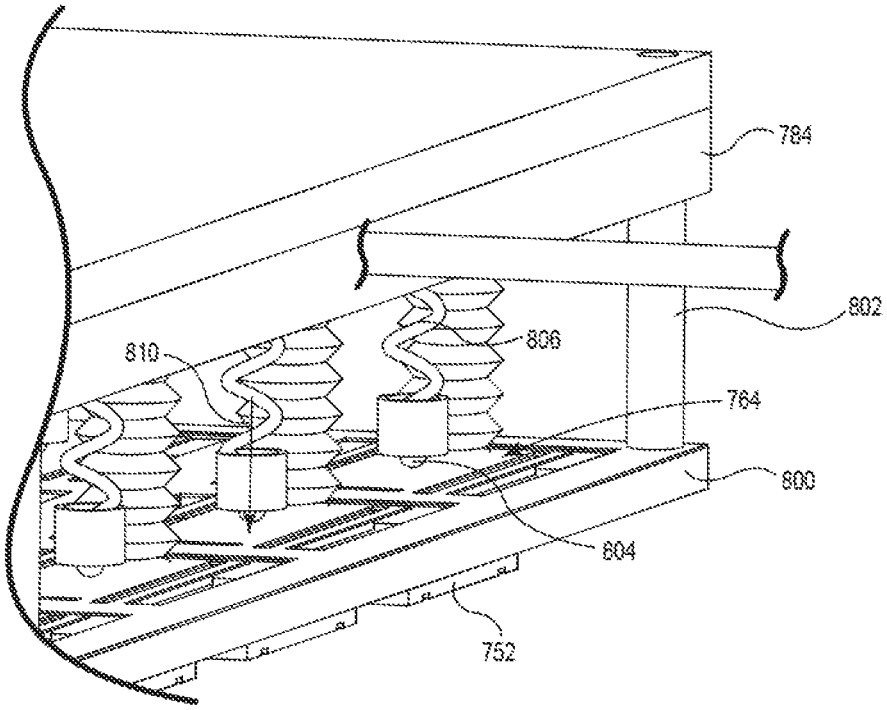
FIG. 47 is a perspective view the dressing bar assembly of FIG. 43.

As best illustrated in FIG. 47, dimple structures 804 are interposed between springs 806 and the gimbal mechanisms 764. The dimple structure 804 delivers preload 810 as a point source. Adjacent to the springs 806 and the dimples 804 are the flexible bellows 790 that deliver the external pressure to each individual dressing bar 752 via the gimbal mechanisms 764.

Holder structure 800 is attached to the preload structure 784 by stand-offs 802. The holder structure 800 sets the preload 810 applied on each dressing bar 752 and limits the deformation of the gimbal mechanisms 764 in order to avoid damage. The gimbal mechanisms 764, preload structure 784, and holder structure 800 can also be used in a hydrodynamic application without the hydrostatic pressure ports 760 and bellows couplings 790.

Figure 48:
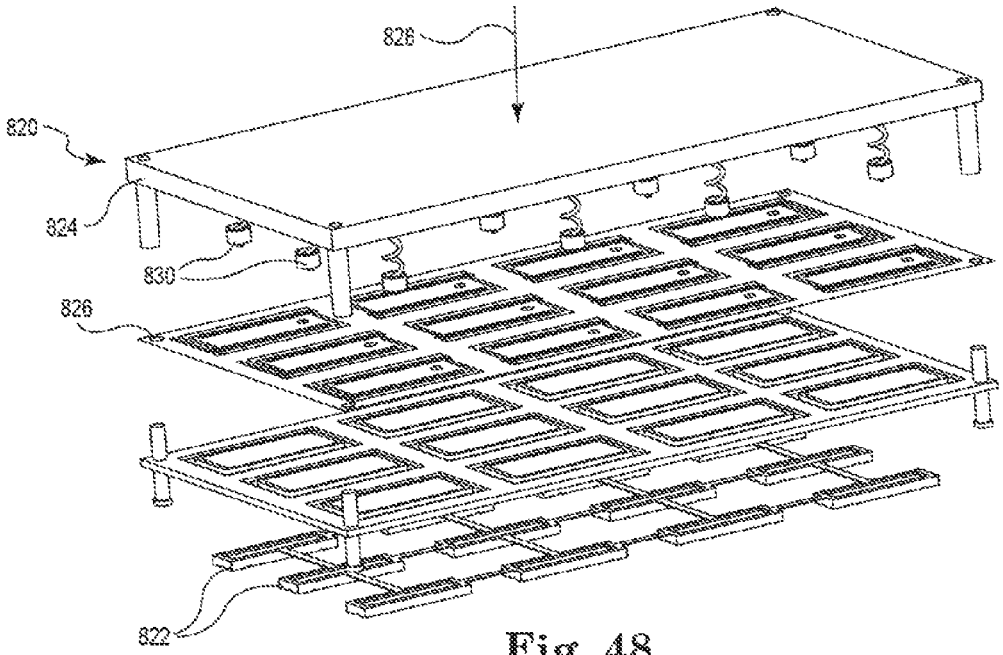
FIG. 48 is a perspective view of a dressing bar assembly with an array of individually gimballed dressing bars in accordance with an embodiment of the present invention.
Figure 49:
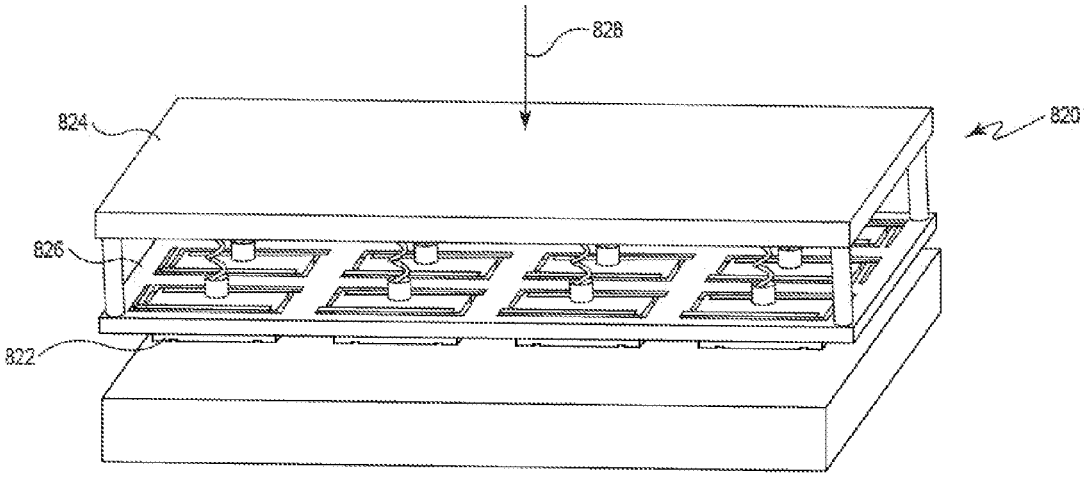
FIG. 49 is an exploded view of the dressing bar assembly of FIG. 48.

FIGS. 48 and 49 illustrate an alternate dressing bar assembly 820 substantially as shown in FIG. 43, without the hydrostatic control, in accordance with an embodiment of the present invention. An array of dressing bars 822 is attached to preload structure 824 by an array of gimbal mechanisms 826. Preload 828 is transmitted to the gimbal mechanisms 826 by dimpled springs 830, generally as discussed above. The suspended dressing bars 822 have a static pitch and roll stiffness through the hydrodynamic fluid bearing and a z-axis stiffness through the gimbal mechanisms 826. Bottom surfaces of the dressing bars 822 preferably have fluid bearing features, such as illustrated in FIG. 45B.

Figure 50:
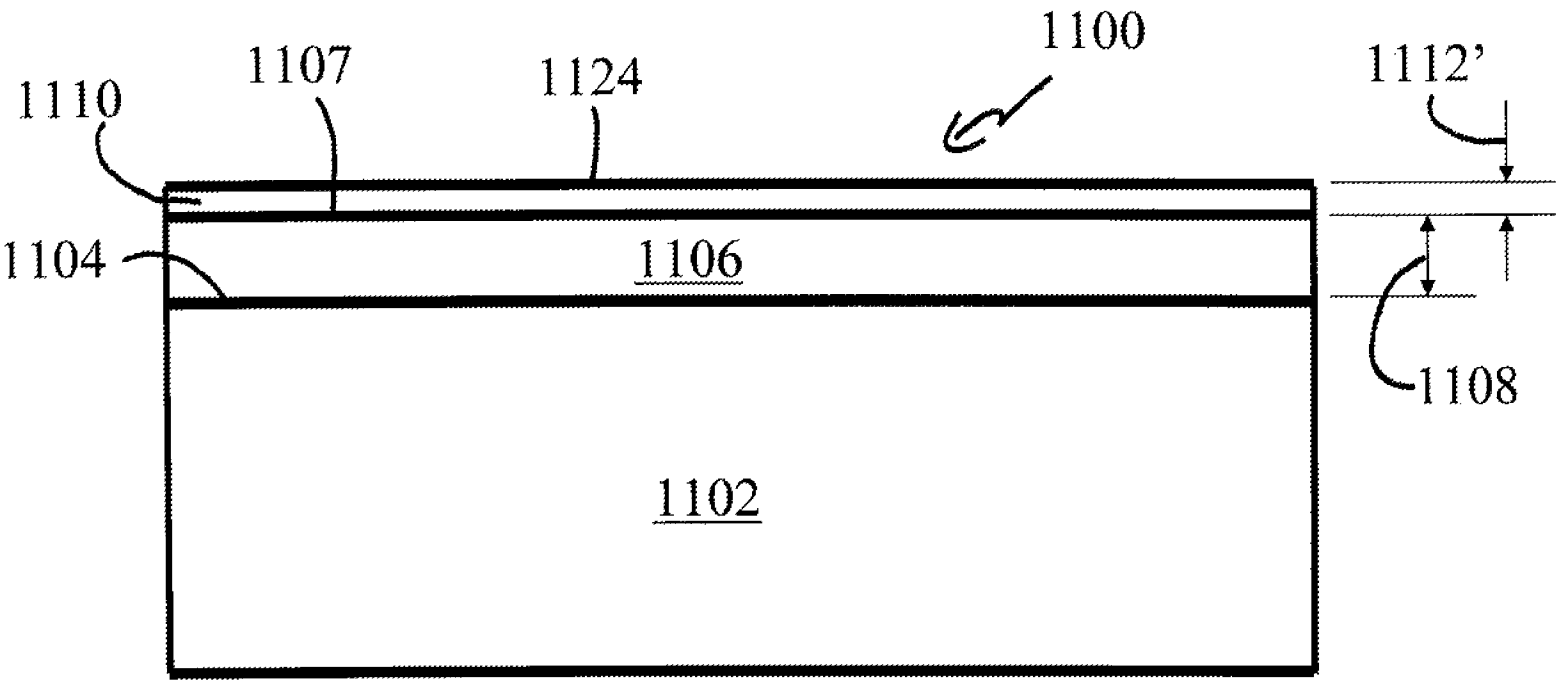
FIG. 50 is a schematic side sectional view of a fixture for making an abrasive article in accordance with an embodiment of the present invention.

FIG. 50 illustrates fixture 1100 for making a substantially uniform height diamond charged abrasive article in accordance with a method of the present invention. Master plate 1102 is machined and polished to a substantially flat surface 1104.

Roughness of a surface can be measured in a number of different ways, including peak-to-valley roughness, average roughness, and RMS roughness. Peak-to-valley roughness (Rt) is a measure of the difference in height between the highest point and lowest point of a surface. Average roughness (Ra) is a measure of the relative degree of coarse, ragged, pointed, or bristle-like projections on a surface, and is defined as the average of the absolute values of the differences between the peaks and their mean line.

The master plate 1102 is preferably silicon, silicon carbide, or silicon nitride, since wafer planarization infrastructure is capable of achieving a roughness (Ra) of about 0.5 Angstroms. The fine finish requirements for the surface 1104 includes peak-to-peak short length waviness of about 10 nanometers to about 40 nanometers, peak-to-peak long waviness of less than about 5 microns, and surface finish quality with an Ra of 0.5 Angstroms. Planarization of silicon is disclosed in U.S. Pat. No. 6,135,856 (Tjaden et al.) and U.S. Pat. No. 6,194,317 (Kaisaki et al.) are hereby incorporated by reference.

Once the master plate 1102 is machined, a hard coat 1106 is preferably applied to protect the surface 1104. Surface 1107 of the hard coat 1106 generally tracks the surface 1104 of the master plate 1102. The desired thickness 1108 of the hard coat 1106 can be in the range of about 100 nanometers or greater. In one embodiment, the hard coat 1106 is diamond-like carbon ("DLC") with a thickness 1108 of about 100 nanometers to about 200 nanometers. DLC hardness is preferably more than about 5 GPa to adequately protect the surface 1104. It is highly desirable to generate DLC hardness in the range of 70-90 GPa.

In one embodiment the DLC is applied by chemical vapor deposition. As used herein, the term "chemically vapor deposited" or "CVD" refers to materials deposited by vacuum deposition processes, including, but not limited to, thermally activated deposition from reactive gaseous precursor materials, as well as plasma, microwave, DC, or RF plasma arc jet deposition from gaseous precursor materials. Various methods of applying a hard coat to a substrate are disclosed in U.S. Pat. No. 6,821,189 (Coad et al.); U.S. Pat. No. 6,872,127 (Lin et al.); U.S. Pat. No. 7,367,875 (Slutz et al.); and U.S. Pat. No. 7,189,333 (Henderson), which are hereby incorporated by reference.

The next step is to apply a spacer layer 1110. The spacer layer 1110 is preferably a low surface energy coating, such as for example Teflon. The spacer layer 1110 acts as a spacer to set height 1112 abrasive particles 1114 protrude above reference surface 1116 on the abrasive article 1118 (see FIG. 54A). Consequently, by varying the thickness 1112' of the spacer layer 1110, the height 1112 of the abrasive particles 1114 can be controlled.

In some embodiments, the thickness 1112' may be different than the height 1112 of the abrasive particles 1114 to compensate for deformation of the spacer layer 1110 during impregnation of the substrate (see FIG. 53) and other manufacturing variability. As a result, the thickness 1112' of the spacer layer 1110 corresponds to the desired height the abrasive particles 1114 protrude above the reference surface 1116, but there is not necessarily a one-to-one correlation.

In one embodiment the spacer layer 1110 is a preformed sheet bonded or adhered to the surface 1107 of the hard coat 1106. In another embodiment, the spacer layer 1110 is sprayed or printed onto the surface 1107, such as disclosed in U.S. Pat. No. 7,485,345 (Renn et al.) and U.S. Pat. Publication No. 2008/0008822 (Kowalski et al.), which are hereby incorporated by reference.

Figure 51:
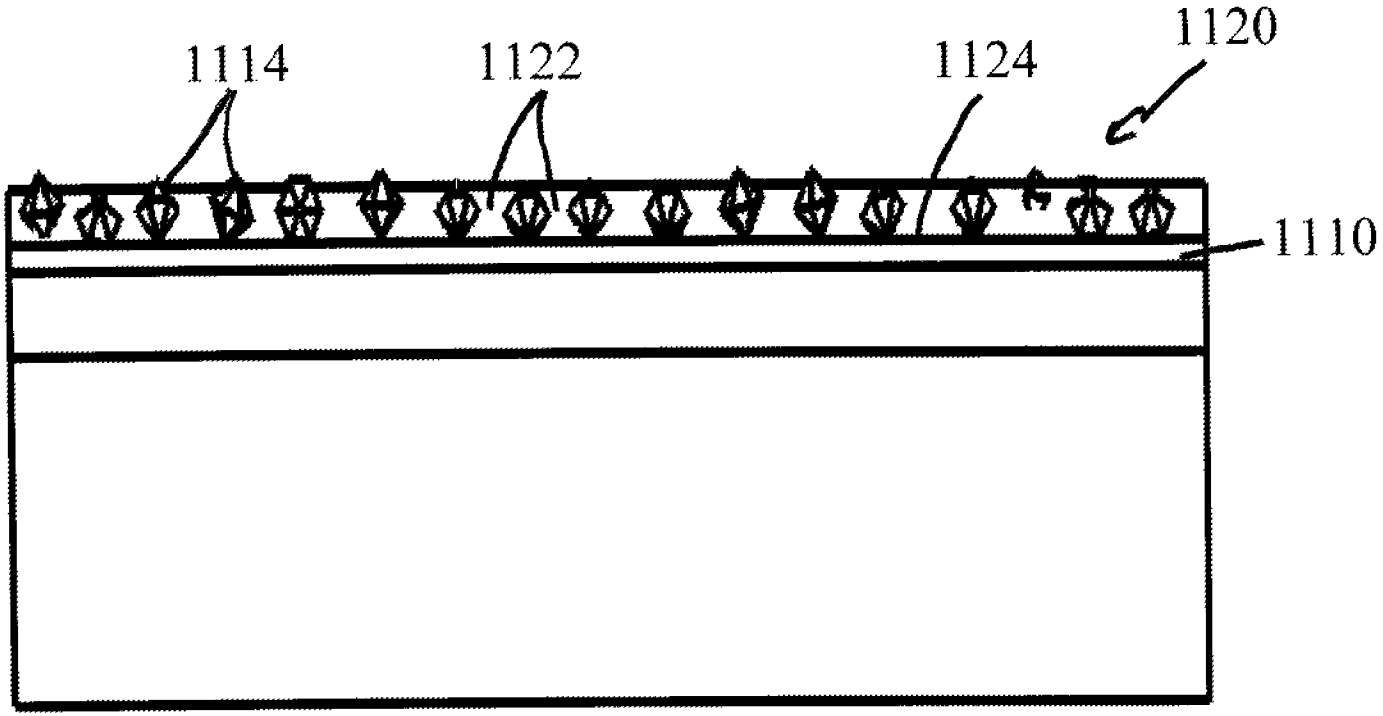
FIG. 51 illustrates an abrasive slurry deposited on the fixture of FIG. 50 in accordance with an embodiment of the present invention.

As illustrated in FIG. 51 adhesive slurry 1120 of adhesive 1122 containing abrasive particles 1114 is distributed evenly over surface 1124 of the spacer layer 1110. Using a spacer layer 1110 made from a low surface tension material aids in wetting the adhesive 1122. Methods of uniformly dispersing nanometer size abrasive grains are disclosed in U.S. Pat. Pub. No. 2007/0107317 (Takahagi et al.), which is hereby incorporated by reference.

Abrasive particle of any composition and size can be used with the method and apparatus of the present invention. The preferred abrasive particles 1114 are diamonds with primary diameters less than about 1 micrometer, also referred to as nano-scale. For some applications, however, the diamonds can have a primary diameter of about 100 nanometers to about 20 micrometers.

Figure 52:
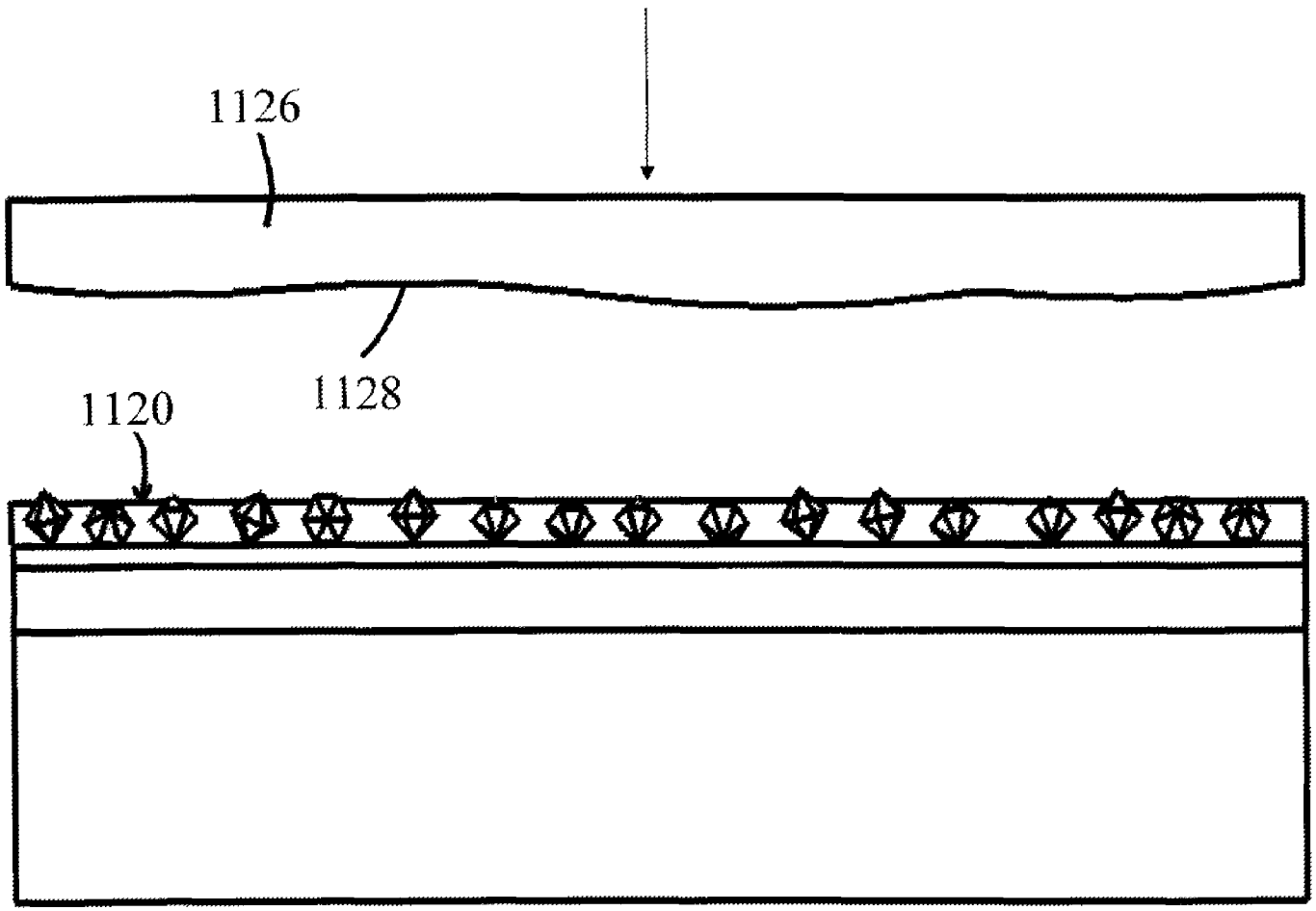
FIG. 52 illustrates a substrate engaged with the abrasive slurry FIG. 51 in accordance with an embodiment of the present invention.

Substrate 1126 illustrated in FIG. 52 is then pressed against the adhesive slurry 1120. In the illustrated embodiment, the substrate 1126 is a tin plate. Note that surface 1128 of the substrate 1126 has some waviness, which will be covered by adhesive 1122 in the abrasive article 1118 according to the present invention. The substrate 1126 can be manufactured from a variety of metals, polymeric materials, ceramics, or composites thereof. The substrate 1126 can also be flexible, rigid, or semi-rigid.

Figure 53:
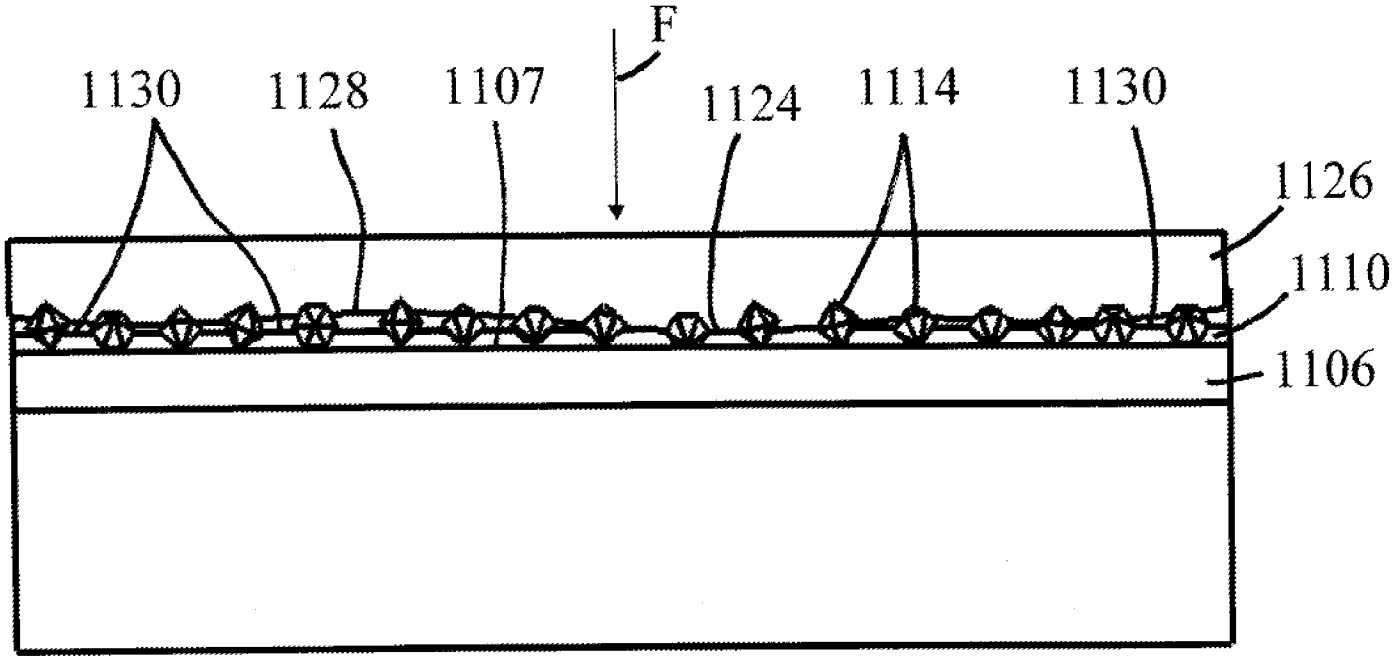
FIG. 53 illustrates the abrasive particles embedded in the substrate and the spacer layer of FIG. 52 in accordance with an embodiment of the present invention.

As illustrated in FIG. 53, the substrate 1126 is applied with a sufficient force F to cause the abrasive particles 1114 to substantially penetrate the spacer layer 1110, without substantial penetration or indentations in the hard coat 1106. The abrasive particles 1114 are also embedded in surface 1128 of the substrate 1126. The abrasive particles 1114 typically penetrate the relatively softer spacer layer 1110 until they contact the hard coat 1106 before penetrating the substrate 1126. The adhesive 1122 preferably fills gaps 1130 between the surface 1128 of the substrate 1126 and the surface 1124 of the spacer layer 1110. The adhesive 1122 also follows the contour of the surface 1124 of the spacer layer 1110, as will be discussed below.

The spacer layer 1110 permits the abrasive particles 1114 to contact the surface 1107 of the hard coat 1106 and limits the amount of penetration into the substrate 1126. Depending on the material selected, the thickness of the spacer layer 1110 may be increased to compensate for deformation during the impregnating step of FIG. 53.

The surface 1128 of the substrate 1126 preferably has a flatness that is less than about the height of the abrasives particles 1114, so the abrasive particles 1114 are sufficiently embedded in the surface 1128. If the abrasive particles 1114 are not sufficiently embedded into the substrate 1126, the adhesive 1122 may be the primary mode of attachment, leading to release during lapping.

Figure 54A:
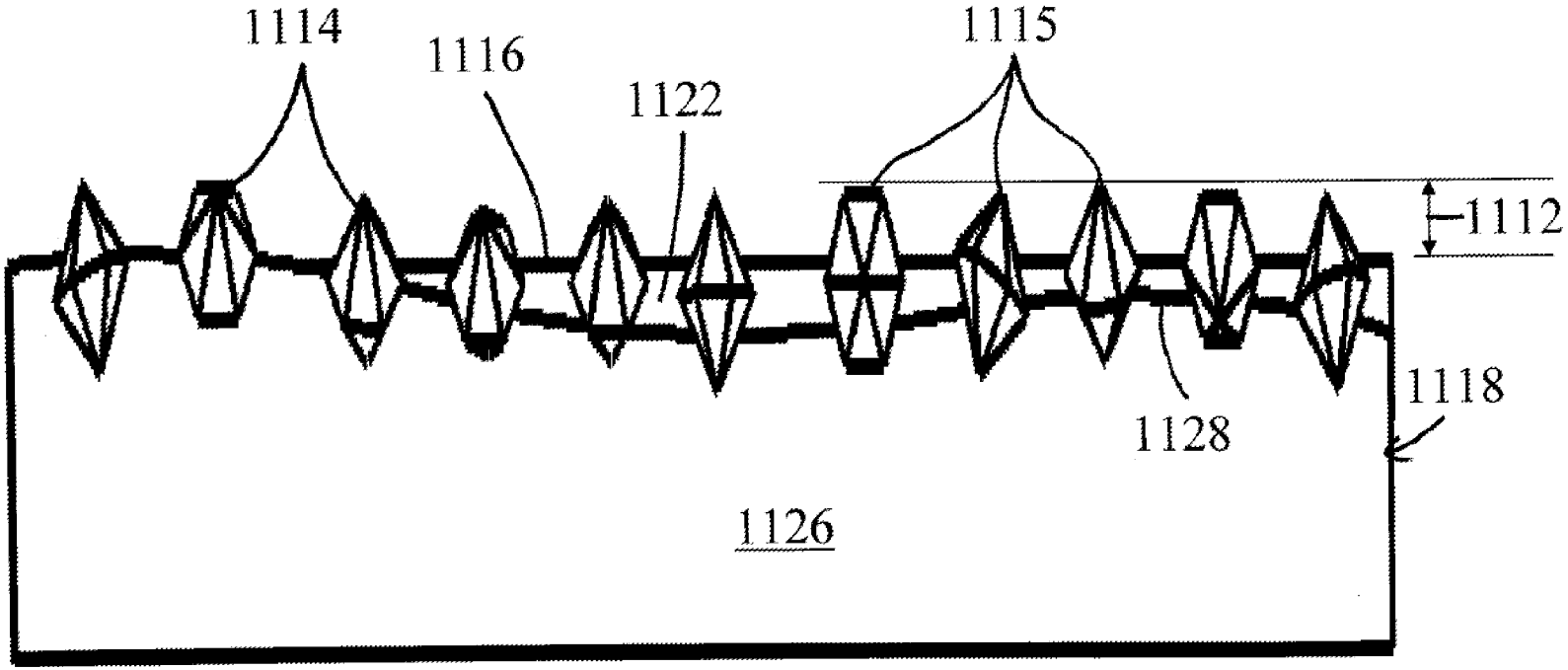
FIG. 54A is a schematic sectional view of an abrasive article in accordance with an embodiment of the present invention.

FIG. 54A illustrates the abrasive article 1118, with the sacrificial spacer layer 1110 removed in accordance with an embodiment of the present invention. Using a spacer layer 1110 made from a low surface tension material facilitates removal of the master plate 1102. The at least partially cured adhesive 1122 forms a reference surface 1116 from which height 1112 of the abrasive particles 1114 can be measured. The reference surface 1116 corresponds to the shape of the surface 1124 of the spacer layer 1110.

The waviness of the surface 1128 on the substrate is not reflected in the uniform height 1112 of the abrasive particles 1114 or the reference surface 1116. The uniform distance 1112 between the peaks 1115 of the abrasive particles 1114 and the reference surface 1116 permits formation of a substantially uniform hydrodynamic film relative to the height 1112 of the abrasive particles 1114. As used herein, "substantially uniformly" and "substantially flat" refers to both an entire surface of a substrate or an abrasive article and to selected portions of the substrate or abrasive article. For example, localized uniformity or flatness may be sufficient for some applications.

Various processes can be used to activate and/or cure the adhesive 1122 to bond the diamonds 1114 to the substrate 1126 and create the reference surface 1116, such as for example ultraviolet or infrared RF energy, chemical reactions, heat, and the like. As used herein, "cure" or "activate" refers to any chemical transformation (e.g., reacting or cross-linking), physical transformation (e.g., hardening or setting), and/or mechanical transformation (e.g., drying or evaporating) that allows an adhesive to change or progress from a first physical state (generally liquid or flowable) into a more permanent second physical state or form (generally solid).

Figure 54B:
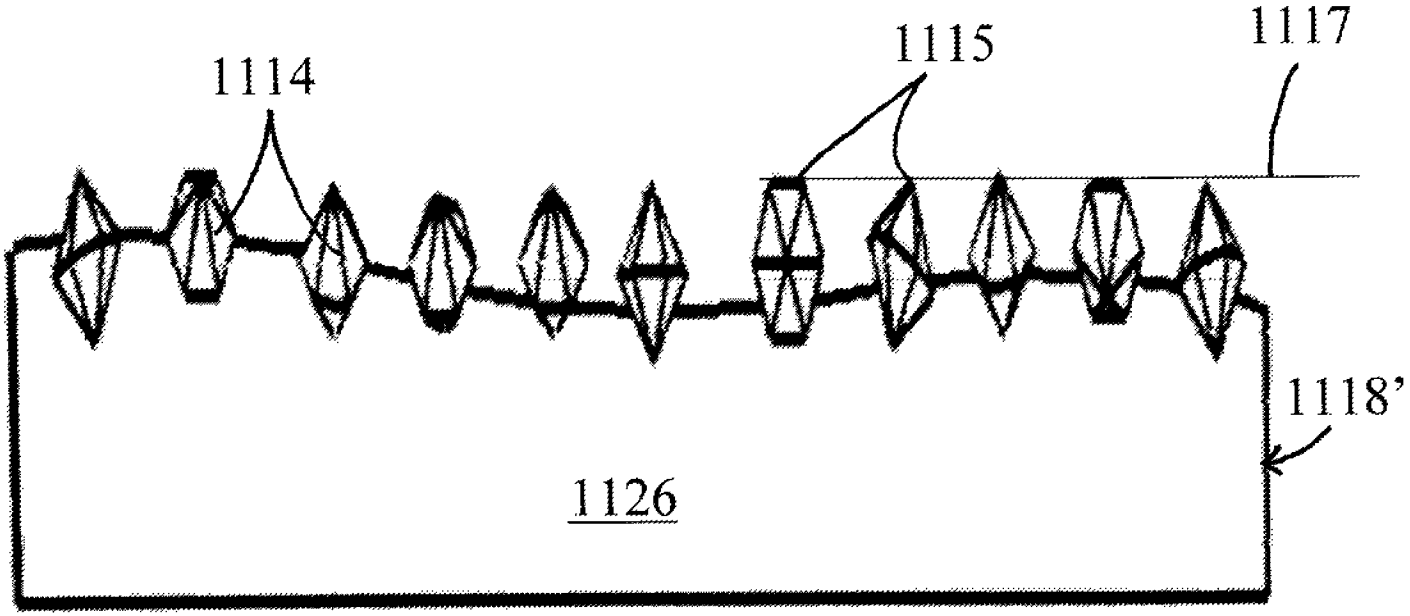
FIG. 54B is a schematic sectional view of an alternate abrasive article without the adhesive layer in accordance with an embodiment of the present invention.

FIG. 54B illustrates an alternate abrasive article 1118' without an adhesive in accordance with an embodiment of the present invention. The abrasive particles 1114 are embedded in the substrate 1126, so an adhesive is not required. The peaks 1115 of the abrasive particles 1114 are substantially coplanar 1117. In embodiments where the abrasive article is not planar, the peaks of the abrasive particles correspond to the contour of the surface of the master plate. Any of the embodiments disclosed herein can be created without the adhesive in the slurry of abrasive particles.

The present methods provide a number of benefits over prior art diamond charged lapping plates. The present abrasive article 1118 provides a uniform height 1112 of the diamonds 1114 ("dh") with respect to a substantially flat reference surface 1116. There is no need to condition the present abrasive article 1118. Knowledge of the lapping conditions, lubricant type, and the lapped bar can be used to calculate the hydrodynamic film thickness ("hf") relative to the reference surface 1116 formed by the cured adhesive 1122. Once the hydrodynamic film thickness is known, the interference ("I") can be calculated from the uniform height 1112 of the diamonds 1114 from the hydrodynamic film (I=dh−hf). The substantially flat reference surface 1116 provides a generally uniform hydrodynamic film, which translates into uniform forces at the slider bar/abrasive article interface. Constant interference (I) of the abrasive diamonds 1114 during the lapping process leads to a notable reduction in occurring of scratches, a substantial improvement in pole tip recession critical to the performance of magnetic recording heads, and a substantial improvement in surface roughness.

Note that the substrate 1126 has historically been a tin plate because of ease of charging the diamonds 1114 and dressing the plate. Since the height 1112 of the protruding diamonds 1114 is controlled by the thickness of the spacer layer 1110, however, other relatively harder materials are also good candidates for this application, such as for example soft steels, copper, aluminum, and the like.

While the application discussed above is lapping slider bars for disk drives, for the present abrasive article 1118 has a wide range of other industrial applications, such as for example lapping semiconductor wafers and polishing metals.

Figure 55:
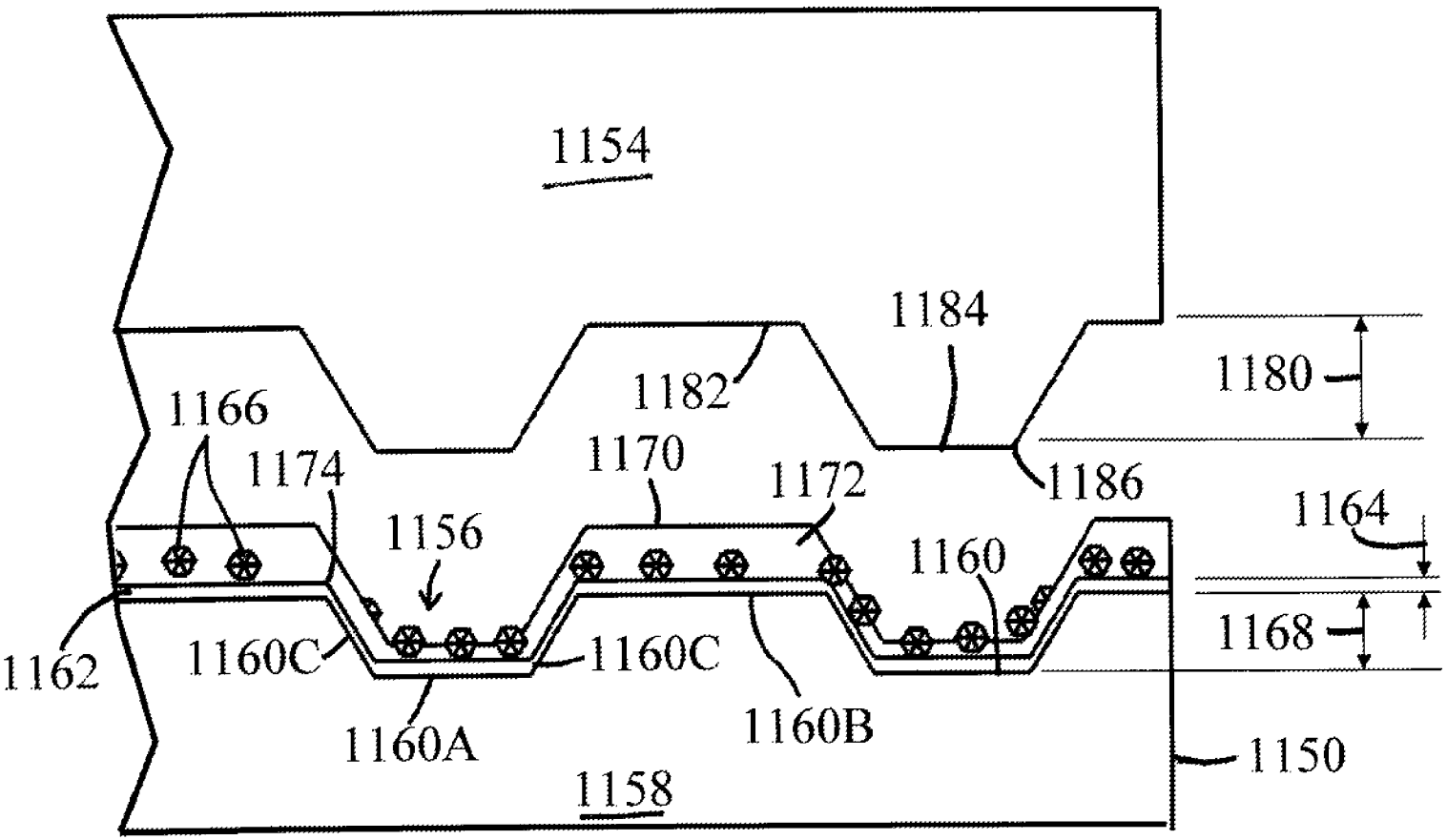
FIG. 55 is a schematic side sectional view of an alternate fixture with a structured surface for making an abrasive article in accordance with an embodiment of the present invention.

FIG. 55 illustrates a fixture 1150 for manufacturing an abrasive article 1152 with a structured substrate 1154 (see FIG. 57) in accordance with an embodiment of the present invention. The desired structures 1156 are machined in the master plate 1158. The structures 1156 can be linear, curvilinear, regular, irregular, continuous, discontinuous, or a variety of other configurations. Various structured substrates and adhesives suitable for use in the present invention are disclosed in U.S. Pat. No. 6,194,317 (Kaisaki et al); U.S. Pat No. 6,612,917 (Bruxvoort); U.S. Pat. No. 7,160,178 (Gagliardi et al.); U.S. Pat. No. 7,404,756 (Ouderkirk et al.); and U.S. Publication No. 2008/0053000 (Palmgren et al.), which are hereby incorporated by reference.

In the illustrated embodiment, the structures 1156 are a series of grooves. The surfaces 1160 of the grooves 1156 can be machined with a continuous curvilinear shape, a series of discrete curvilinear or flat shapes with transition locations, or a combination thereof. In the illustrated embodiment, the grooves 1156 include valleys 1160A, peaks 1160B, and side surfaces 1160C (collectively "1160"). The peaks 1160B have substantially uniform peak height 1168.

In the illustrated embodiment, the master plate 1158 is machined with a hard ceramic material such as TiC or TiN. The hard coat is optional and is not shown in the embodiment of FIG. 55. Spacer layer 1162 is then deposited on the surface 1160 of the grooved master plate 1158 with a thickness 1164 corresponding the desired protruding height of abrasive particles 1166. An adhesive slurry 1170 including adhesive 1172 and abrasive particles 166 is distributed evenly over the grooved surface 1174 of the spacer layer 1162.

Figure 56:
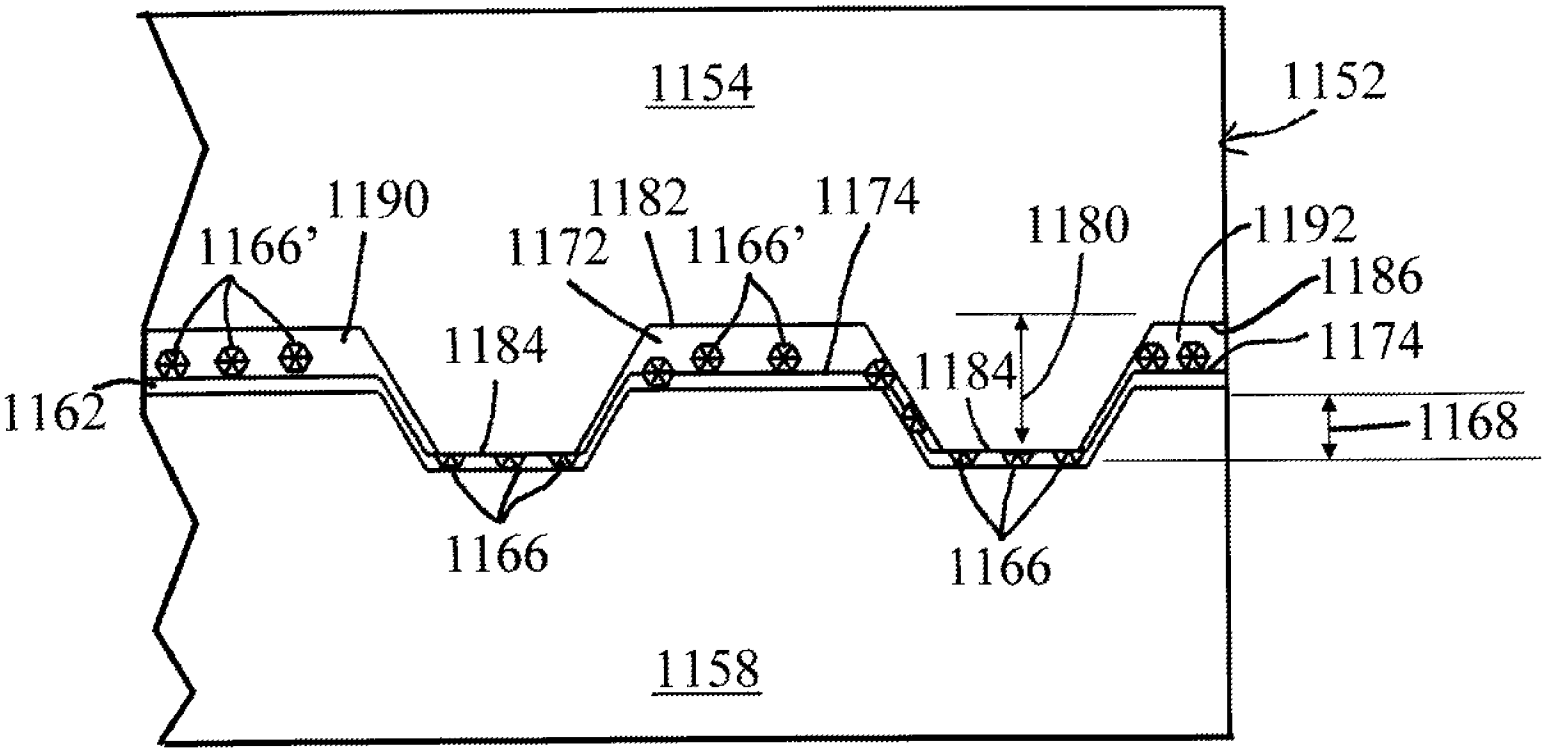
FIG. 56 illustrates a substrate engaged with the abrasive slurry of FIG. 55 in accordance with an embodiment of the present invention.

As illustrated in FIG. 56, the substrate 1154 with features 1182 generally corresponding to grooves 1156 is then pressed against the adhesive slurry 1170 with a sufficient force to cause the abrasive particles 1166 to substantially penetrate the spacer layer 1162, without substantial penetration into the master plate 1158. The abrasive particles 1166 also penetrate into the substrate 1154, primarily at peaks 1184.

The grooves 1182 in the substrate 1154 are preferably fabricated with a peak height 1180 greater than peak height 1168 of the grooves 1156 machined in the grooved master plate 1158. The greater peak height 1180 on the substrate 1154 permits the abrasive particles 1166 located along critical peaks 1184 to be firmly embedded in the substrate 1154. Any inaccuracy in the machining of the heights 1168, 1180 of the grooves 1156, 1182 is preferably located in the non-critical valleys 1190 on the abrasive article 1152. Note that portion of the abrasive particles 1166' located in the valleys 1190 are not embedded in the substrate 1154, but are secured to the substrate 1154 by the adhesive 1172.

The spacer layer 1162 controls the depth of penetration of the abrasive particles 1166 into the substrate 1154. The adhesive 1172 fills any gaps 1192 between the surface 1186 of the substrate 1154 and the surface 1174 of the spacer layer 1162. The flatness requirement of the substrate 1154 is less than about the height of the abrasives particles 1166 so as to be embedded a sufficient amount in the surface 1186 of the substrate 1154.

Figure 57:
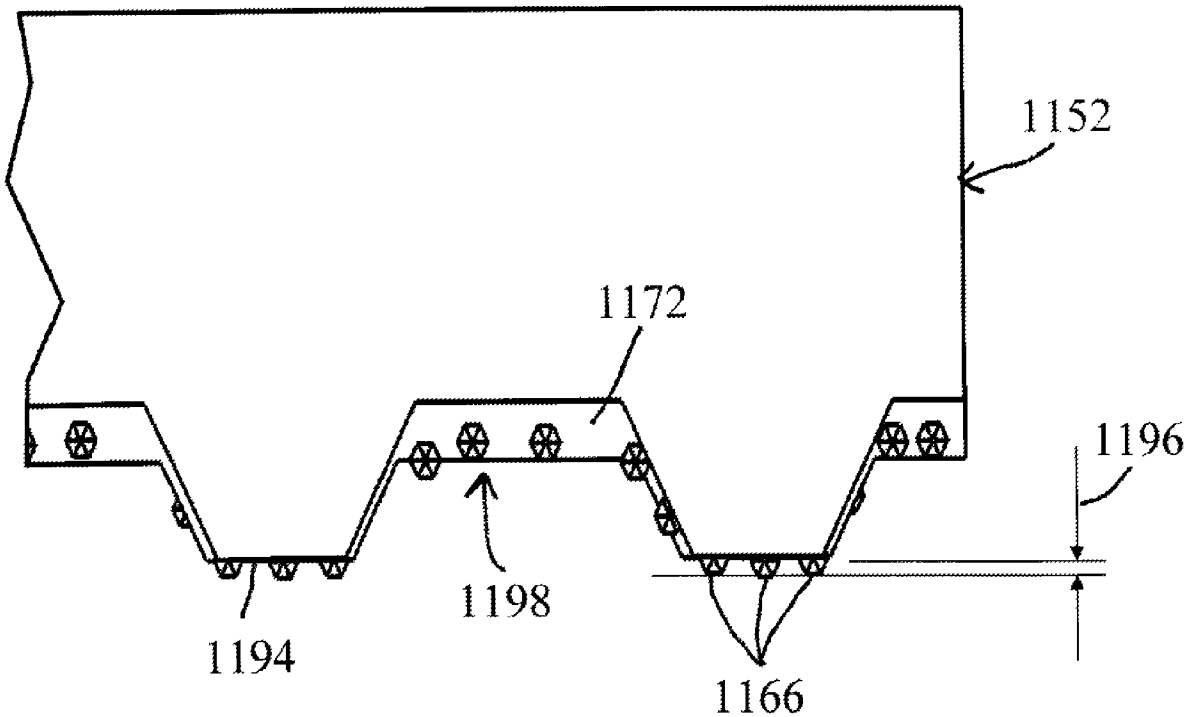
FIG. 57 is a schematic sectional view of an abrasive article with a structure surface in accordance with an embodiment of the present invention.

FIG. 57 illustrates the abrasive article 1152, with the sacrificial spacer layer 1162 removed. The at least partially cured adhesive 1172 forms a substantially flat reference surface 1194 from which height 1196 of the abrasive particles 1166 can be measured. The reference surface 1194 also provides a substantially uniform hydrodynamic film relative to the height 1196 of the abrasive particles 1166.

The grooves 1198 in the abrasive article 1152 are designed to promote lubricant transfer from inner diameter to outer diameter under centrifugal forces to carry the wear by-products and reduce the height of the hydrodynamic film to promote aggressive material removal. Various geometrical features and arrangement of abrasive particles on abrasive articles are disclosed in U.S. Pat. No. 4,821,461 (Holmstrand), U.S. Pat. No. 3,921,342 (Day), and U.S. Pat. No. 3,683,562 (Day), and U.S. Pat. Pub. No. 2004/0072510 (Kinoshita et al), which are hereby incorporated by reference.

The present method of manufacturing uniform height fixed abrasive articles includes preparing a master plate with a shape that is generally a mirror image of the desired uniform height fixed abrasive article. A hard coat is optionally applied protect the surface of the master plate. A spacer layer is deposited on the master plate or hard coat. Adhesive slurry containing adhesive and abrasive particles is distributed evenly over surface of the spacer layer. A substrate with a surface that is generally a mirror image of the master plate is then pressed against the adhesive slurry to embed the abrasive particles into the substrate. The spacer layer controls the penetration of the abrasive particles into the substrate. The adhesive fills gaps between the surface of the substrate and the surface of the spacer layer. The substrate containing the embedded abrasive particles is separated from the master plate and the sacrificial spacer layer is removed. The at least partially cured adhesive forms a substantially flat reference surface between the protruding abrasive particles.

It will be appreciated that the present method of manufacturing uniform height fixed abrasive articles can be used with a variety of shaped substrates, such as for example concave surfaces, convex surfaces, cylindrical surfaces, spherical surfaces, and the like. The present method is not dependent on the size or composition of the abrasive particles.

Figure 58:
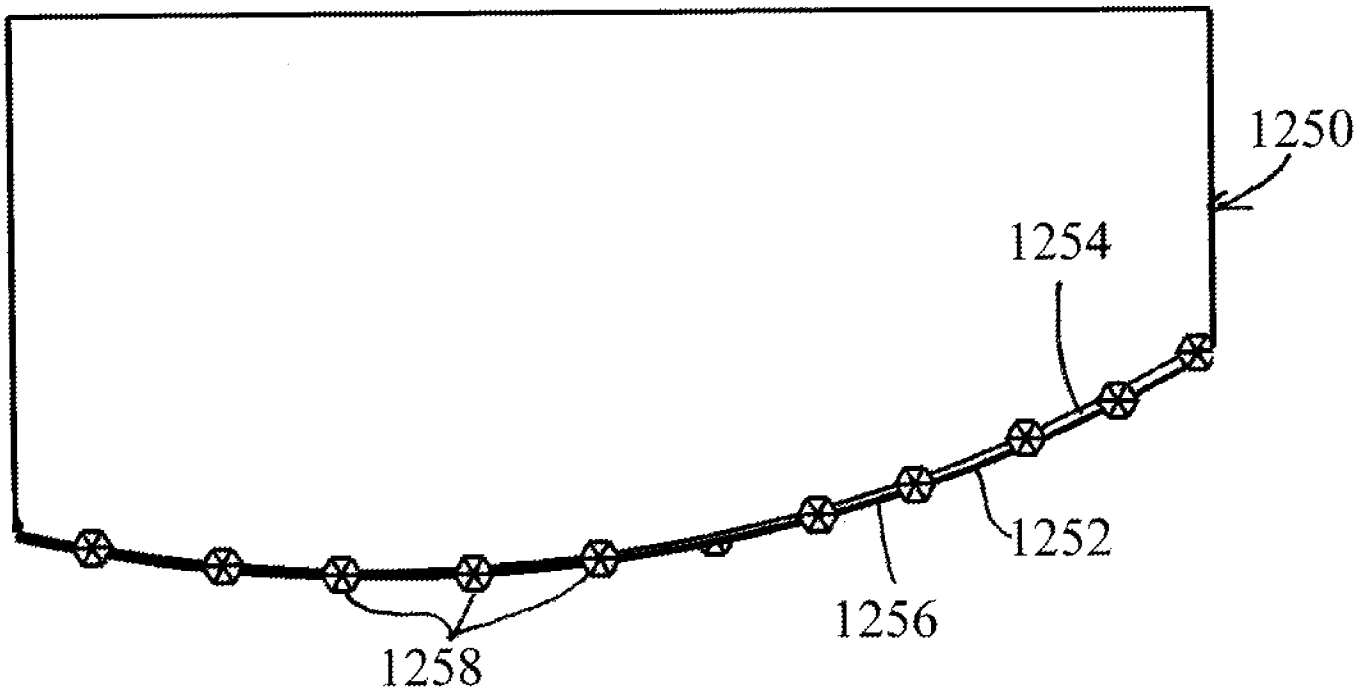
FIG. 58 is a schematic sectional view of an abrasive article with a convex surface in accordance with an embodiment of the present invention.

FIG. 58 is a side sectional view of a uniform height fixed abrasive article 1250 with a convex surface 1252 in accordance with an embodiment of the present invention. The convex surface 1252 can be circular, curvilinear, and a variety of other regular and irregular curved shapes. As with the embodiments discussed above, adhesive 1254 provides a uniform reference surface 1256. The abrasive particles 1258 extend a substantially uniform amount above the reference surface 1256. The reference surface 1256 is also smooth so as to promote a substantially uniform hydrodynamic film.

Figure 59:
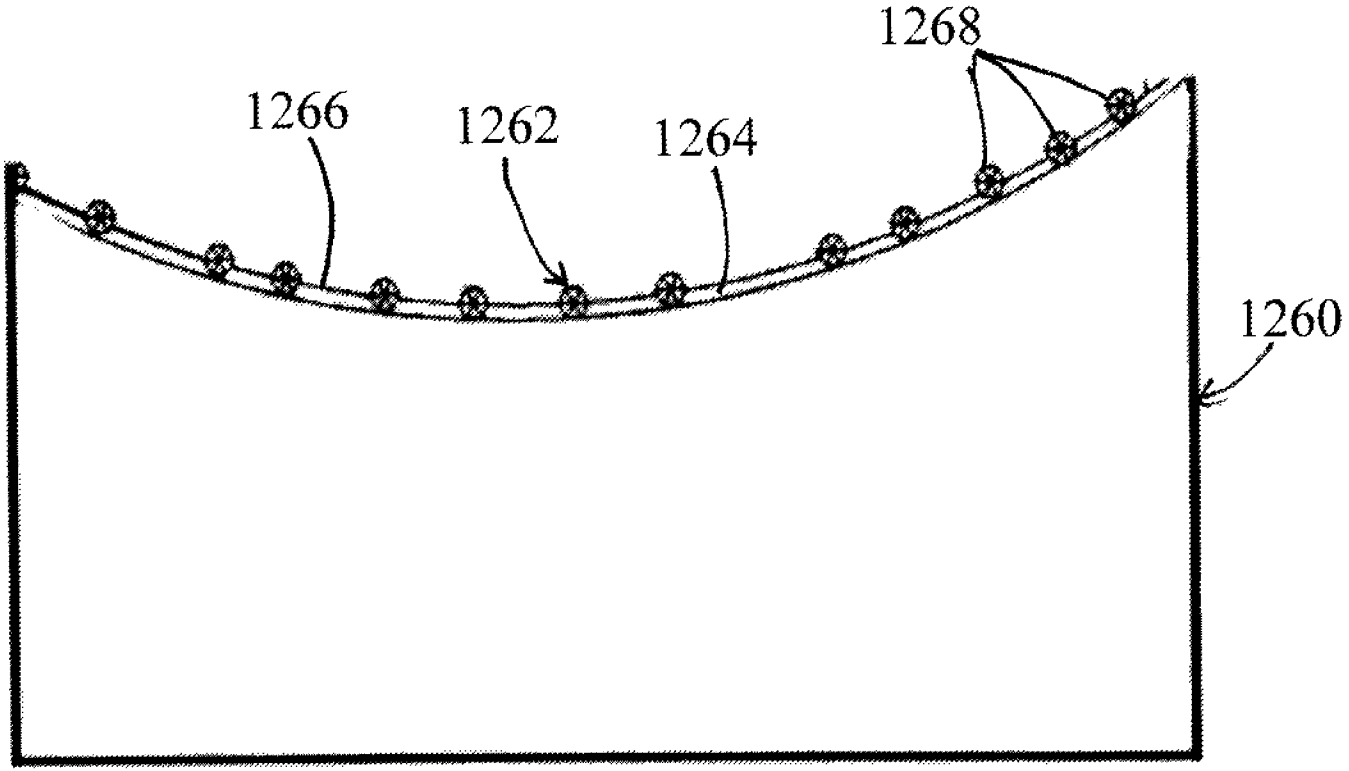
FIG. 59 is a schematic sectional view of an abrasive article with a concave surface in accordance with an embodiment of the present invention.

FIG. 59 is a side sectional view of a uniform height fixed abrasive article 1260 with a concave surface 1262 in accordance with an embodiment of the present invention. The concave surface 1262 can be circular, curvilinear, and a variety of other regular and irregular curved shapes. As with the embodiments discussed above, adhesive 1264 provides a uniform reference surface 1266. The abrasive particles 1268 extend a substantially uniform amount above the reference surface 1266.

Figure 60:
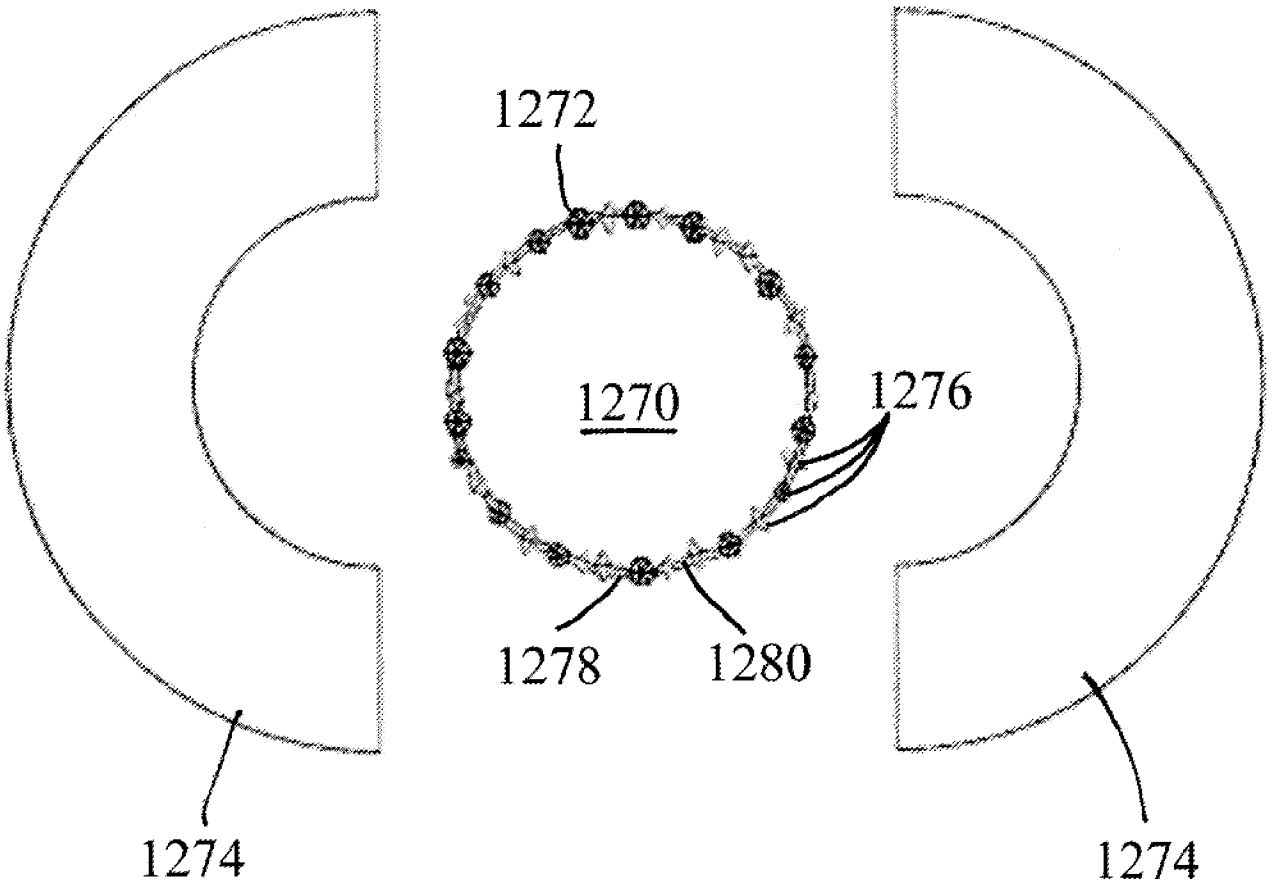
FIG. 60 is a schematic sectional view of an abrasive article with a cylindrical or spherical surface in accordance with an embodiment of the present invention.

FIG. 60 is a top view of a uniform height fixed abrasive article 1270 with a cylindrical surface 1272 and the associated master plates 1274 in accordance with an embodiment of the present invention. The abrasive particles 1276 extends a substantially uniform amount above the reference surface 1278 created by the cured adhesive 1280.

The curved abrasive articles of FIGS. 58-60 are particularly suited for polishing machined metal parts, such as for example components for engines and transmissions, where a significant reduction in friction will translate into greater fuel efficiency.

Figure 61:
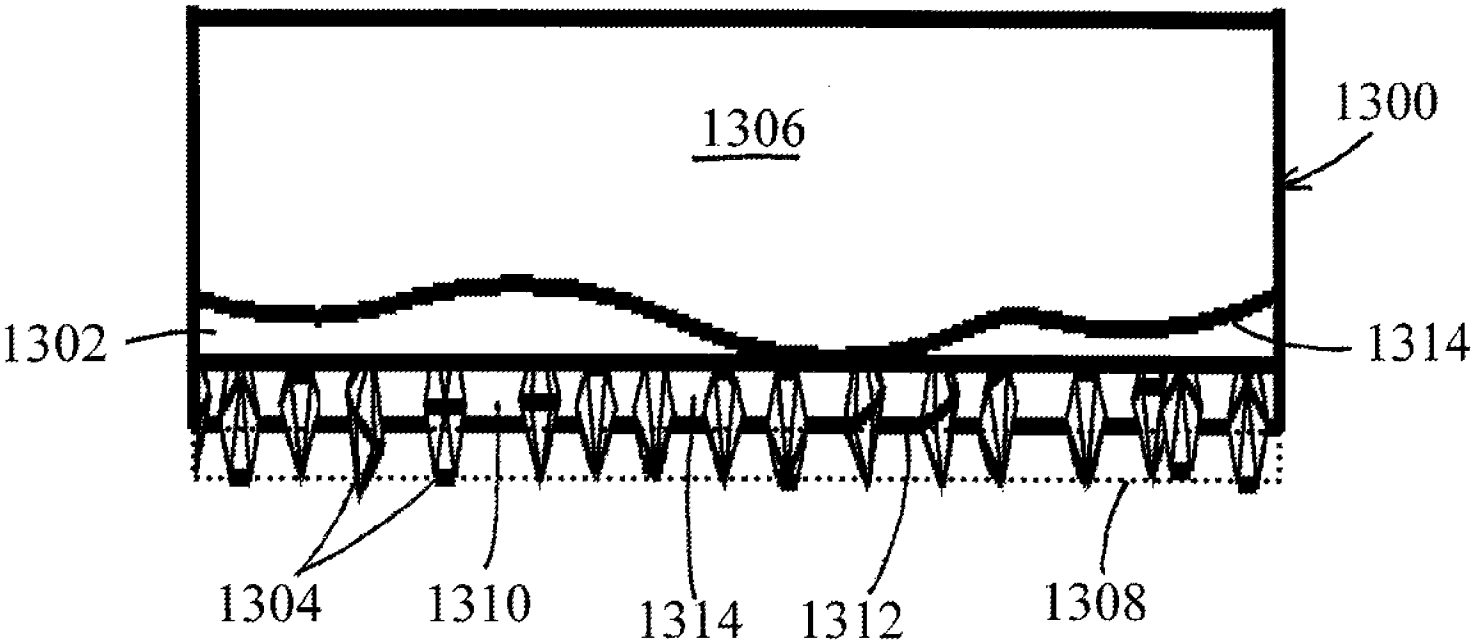
FIG. 61 is a schematic sectional view of an abrasive article with abrasive particles sintered to a substrate in accordance with an embodiment of the present invention.

FIG. 61 illustrates a uniform height fixed abrasive article 1300 in accordance with any of the embodiments disclosed above, that uses the two step adhesion process disclosed in U.S. Pat. Nos. 7,198,553 and 6,123,612, which are hereby incorporated by reference. The abrasive particles 1304 are embedded in the substrate 1306 using sacrificial layer 1308 as discussed herein. Elevated heat and pressure are applied to a sintered powder matrix material and a brazing alloy 1302 to create a chemical bond between the abrasive particles 1304 and surface 1314 of the substrate 1306. The sacrificial spacer 1308 (shown in phantom) is preferably a soft metal to avoid excessive deformation during heating of the matrix 1302.

The matrix 1302 lacks the ability to fill the spaces 1310 between the sintered material 1302 and the spacer 1308. A low viscosity curable material 1314, such as for example a thermo-set adhesive, is optionally provided to fill the spaces 1310 and to provide the reference surface 1312 between the abrasive particles 1304. The curable material 1314 also acts as a corrosion barrier to protect the sintered material 1302 from corrosion and other interaction in chemical mechanical polishing applications. In an alternate embodiment, the curable material 1314 is omitted.

Where a range of values is provided, it is understood that each intervening value, to the tenth of the unit of the lower limit unless the context clearly dictates otherwise, between the upper and lower limit of that range and any other stated or intervening value in that stated range is encompassed within the inventions. The upper and lower limits of these smaller ranges which may independently be included in the smaller ranges is also encompassed within the inventions, subject to any specifically excluded limit in the stated range. Where the stated range includes one or both of the limits, ranges excluding either both of those included limits are also included in the inventions.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. A system for making an abrasive article comprising:
abrasive particles in a carrier fluid;
micro-nano scale members;
a substrate; and
a gimballed dressing bar adapted to provide a compressive force sufficient to embed the abrasive particles into the substrate, wherein the micro-nano scale members set a height the embedded abrasive particles protrude above the substrate.

2. The system of claim 1 wherein the dressing bar comprises at least one gas conduit adapted to deliver pressurized gas to one or more pressure ports positioned opposite the substrate, the pressurized gas maintaining a hydrostatic bearing between the dressing bar and the substrate while generating compressive forces sufficient to embed the abrasive particles into the surface.

3. The system of claim 1 wherein the dressing bar comprises one or more fluid bearing features adapted to generate a hydrodynamic fluid bearing during relative motion with the substrate.

4. The system of claim 1 wherein the substrate is one of flexible, rigid, or semi-rigid.

5. The system of claim 1 comprising an adhesive mixed with the carrier fluid.

6. The system of claim 1 wherein the micro-nano scale members comprise a film that acts as a carrier for the abrasive particles prior to being embedded in the substrate.

7. The system of claim 1 wherein the micro-nano scale members comprise a reference surface that permits formation of a substantially uniform hydrodynamic or hydrostatic film relative to the height of the abrasive particles above the substrate.

8. A method of making an abrasive article comprising the steps of:
locating a slurry of abrasive particles, micro-nano members, and a carrier fluid between a substrate and a gimballed dressing bar; and
engaging the gimballed dressing bar with the slurry with sufficient force to embed the abrasive particles into the substrate until the abrasive particles protrude above the substrate a substantially uniform height corresponding to the thickness of the micro-nano scale members.

9. The method of claim 8 comprising the step of preparing the substrate with one of flat, concave, convex, curvilinear, spherical, or grooved surfaces.

10. The method of claim 8 wherein the step of locating the micro-nano scale members on the substrate comprises one of spraying, coating, or printing.

11. The method of claim 8 comprising the step of compressing the micro-nano scale members during the step of embedding the abrasive particles into the substrate.

12. The method of claim 8 comprising the steps of:
adding an adhesive to the slurry; and
at least partially curing the adhesive to form a reference surface between the abrasive particles.

13. The method of claim 8 comprising forming a hydrostatic bearing, a hydrodynamic bearing, or a combination of hydrodynamic/hydrostatic bearings between the dressing bar and the substrate.

14. The method of claim 8 comprising the steps of engaging an array of gimballed dressing bars with the substrate during the step of embedding the abrasive particles into the substrate.

15. The method of claim 14 comprising arranging the array of dressing bars in a circular array, a rectangular array, an off-set pattern, or a random pattern.

16. A method of lapping a surface of a work piece comprising the steps of:
positioning an abrasive article made according to the method of claim 8 opposite the surface of the work piece;
engaging the surface of the work piece with the abrasive particles; and
moving the work piece relative to the abrasive article.

* * * * *